US008342098B2

(12) United States Patent
Shalev et al.

(10) Patent No.: US 8,342,098 B2
(45) Date of Patent: Jan. 1, 2013

(54) NON-LETHAL WIRELESS STUN PROJECTILE SYSTEM FOR IMMOBILIZING A TARGET BY NEUROMUSCULAR DISRUPTION

(75) Inventors: Ilan Shalev, Givataim (IL); Matwey Bereznitsky, Beer Sheva (IL); Haim Danon, Kiryat Ono (IL); Nathan Blaunstein, Beer Sheva (IL); Ginnadii Swarzshtein, Beer Sheva (IL)

(73) Assignee: Security Devices International Inc., Tel Aviv (IL)

( * ) Notice: Subject to any disclaimer, the term of this patent is extended or adjusted under 35 U.S.C. 154(b) by 1607 days.

(21) Appl. No.: 11/450,821

(22) Filed: Jun. 12, 2006

(65) Prior Publication Data

US 2007/0101893 A1 May 10, 2007

Related U.S. Application Data

(60) Provisional application No. 60/698,009, filed on Jul. 12, 2005, provisional application No. 60/698,010, filed on Jul. 12, 2005.

(51) Int. Cl.
*F42B 12/02* (2006.01)
*F42B 30/02* (2006.01)

(52) U.S. Cl. ..... 102/512; 102/502; 361/232

(58) Field of Classification Search ..... 102/502, 102/512; 361/232; 42/1.08, 1.11
See application file for complete search history.

(56) References Cited

U.S. PATENT DOCUMENTS

| | | | | |
|---|---|---|---|---|
| 3,523,538 | A * | 8/1970 | Kunio | 607/58 |
| 3,803,463 | A | 4/1974 | Cover | |
| 4,253,132 | A | 2/1981 | Cover | |
| 5,654,867 | A | 8/1997 | Murray | |
| 5,698,815 | A | 12/1997 | Ragner | |
| 5,962,806 | A * | 10/1999 | Coakley et al. | 102/502 |
| 6,636,412 | B2 | 10/2003 | Smith | |
| 7,086,337 | B2 * | 8/2006 | Klein | 102/502 |
| 7,100,514 | B2 * | 9/2006 | LeBourgeois | 102/502 |
| 7,327,549 | B2 * | 2/2008 | Smith et al. | 361/232 |
| 7,421,951 | B2 * | 9/2008 | Genis et al. | 102/502 |
| 7,631,601 | B2 * | 12/2009 | Feldman et al. | 102/502 |

FOREIGN PATENT DOCUMENTS

CN 2585423 11/2003

* cited by examiner

*Primary Examiner* — James Bergin
(74) *Attorney, Agent, or Firm* — Mark M Friedman

(57) ABSTRACT

A projectile launched from a conventional weapon; upon impact with a human target the projectile attaches to the target and stuns and disables the target by applying a pulsed electrical charge. The electric round is defined as non lethal ammunition directed to incapacitate a human, to prevent him from moving for a short time, to prevent him from committing a crime and to allow authorized personnel to arrest the target. A novel thin film technology transformer and thin film technology battery produce an electrical shock capable of stunning a human being in a device the size of a conventional bullet. The transformer and battery are smaller and lighter than conventional transformers and batteries with similar power output.

33 Claims, 16 Drawing Sheets

NON-LETHAL WIRELESS STUN PROJECTILE SYSTEM FOR IMMOBILIZING A TARGET BY NEUROMUSCULAR DISRUPTION

This is a continuation-in-part of U.S. Provisional Patent Application No. 60/698009, filed Jul. 12, 2005 and U.S. Provisional Patent Application No. 60/698010, filed Jul. 12, 2005.

FIELD AND BACKGROUND OF THE INVENTION

The present invention relates to a non-lethal wireless stun projectile system, and more specifically to a projectile that is launched from a conventional weapon; upon impact with a human target the system stuns and disables the target by applying a pulsed electrical charge. The electric round is defined as non lethal ammunition directed to incapacitate a human, to prevent him from moving for a short time, to prevent him from committing a crime and to allow authorized personnel to arrest the target.

The electric projectile operates by transmitting electric pulses to the target, paralyzing the target for a short time without clinical after effects. Upon impact the projectile attaches itself to the target and gives the same effect as a regular handle electrical shocker. The pulses of electrical current produced by the projectile are significantly lower than the critical cardio-vibration level and therefore the electric pulses are non-lethal. The electrical pulses cause neuromuscular-disruption, which incapacitates a living object.

The current invention also includes a novel thin film technology transformer and thin film technology battery. The transformer and battery are smaller and lighter than conventional transformers and batteries with similar power output. The small high power transformer and battery are necessary in order to produce an electrical shock capable of stunning a human being with a device the size of a conventional bullet.

Increasing attacks on unarmed civilian targets around the world have put governments and law enforcement officials into a difficult position. It is necessary to quickly and effectively stop terrorists and avoid civilian injury, but terrorists are hard to distinguish from innocent civilians and terrorists strike in areas that are not suitable to the positioning of large forces of dedicated guards. Therefore, in order to stop terrorists quickly before they can cause devastating damage, some police forces have adopted a "shoot them in the head" policy. Obviously, such a policy can lead to civilian casualties and controversy. On the other hand, caution in such cases can lead to massive civilian casualties as well as the death of the arresting officer. Also police often desire to apprehend a suspect who is fleeing. Obviously lethal force is inappropriate, but to allow a dangerous criminal to escape is also undesirable.

Therefore law enforcement officials seek a non-lethal weapon that can stop a terrorist without killing innocent civilians. One such weapon, currently popular, is commercialized under the trademark TASER gun [the weapon is disclosed in U.S. Pat. No. 3,803,463 issued Apr. 9, 1974 and now expired and U.S. Pat. No. 4,253,132 issued Feb. 24 1981 and now expired, improvements of the weapon have been disclosed in U.S. Pat. No. 5,654,867 issued Aug. 5 1977 and U.S. Pat. No. 6,636,412 issued Oct. 21, 2003]. The TASER gun shoots two darts with barbed electrodes connected to by wires to the gun body. The wires supply a pulsed electrical potential between the two darts. When both darts hit a target, the barbed electrodes penetrate skin or clothing. An electric circuit is completed and current flows through the target between the electrodes, incapacitating the target. The obvious disadvantages of the TASER gun are 1) the range is limited to the length of the wires 2) both darts must hit the target or the gun has no effect 3) movement of the target or the gun can produce tension on the wires, ripping the electrodes from the target and ending the stunning effect 4) the weapon is difficult to reload and can not be used again quickly in case one of the darts misses the targets, or if it becomes necessary to stun a second target 5) the TASER gun is a dedicated weapon and is very inconvenient for regular police officers who are also required to carry a conventional weapon.

What is needed is a projectile that can be used without hesitation in situations where it may be difficult to absolutely identity or isolate a target. Ideally the projectile should incapacitate the target at a variety of ranges, should be easily loaded fired and reloaded into a conventional firearm (for example an automatic 45 caliper pistol, an M16 assault rifle, a revolver, a standard issue police pistol, or a shotgun) and the projectile should not cause permanent injury. Furthermore, it is desirable that the target remains incapacitated for a few minutes (long enough to secure the area and take the target into custody).

The projectile should be characterized by the following properties:

a. no clinical after effects;
b. wireless (which means not requiring a wire attachment to a stationary power source);
c. self powered;
d. fired from standard/in use weapons without any change in the weapon;
e. ballistic performance similar to standard ammunition;
f. may be stored and handled safely like standard ammunition;
g. may be stored for long time periods (on the order of months or years);
h. can be adapted to different calibers.

SUMMARY OF THE INVENTION

The present invention is a non-lethal wireless stun projectile system. More specifically the present invention is a projectile that is launched from a conventional weapon; upon impact with a human target the system stuns and disables the target by applying a pulsed electrical charge. The electric round is defined as non lethal ammunition directed to incapacitate a human, to prevent him from moving for a short time, to prevent him from committing a crime and to allow authorized personnel to arrest him.

The electric projectile operates by transmitting electric pulses to the target, paralyzing the target for a short time without clinical after effects. Upon impact the projectile attaches itself to the target and gives the same effect as a regular handle electrical shocker. The pulses of electrical current produced by the projectile are significantly lower than the critical cardio-vibration level and therefore the electric pulses are non-lethal. The electrical pulses cause neuromuscular-disruption, which incapacitates a living object.

The current invention also includes a novel thin film technology transformer and thin film technology battery. The transformer and battery are smaller and lighter than conventional transformers and batteries with similar power output. The small high power transformer and battery are necessary in order to produce an electrical shock capable of stunning a human being with a device the size of a conventional bullet.

According to the teachings of the present invention there is provided a wireless projectile for stunning a target including: an impact reduction subsystem to protect the target from impact damage caused by impact of the projectile onto the target, an attachment mechanism to secure the wireless projectile to the target upon impact of the wireless projectile upon the target and an energy delivery subsystem that supplies energy to the target thereby stunning the target after the wireless projectile is secured to the target by the attachment mechanism.

According to the teachings of the present invention, there is also provided a thin film technology galvanic cell for producing an electric potential. The galvanic cell includes: a separator substrate, two electrodes deposited on the separator substrate, and an electrolyte fluid. When the electrolyte fluid is absorbed by the separator substrate, ions are transferred through the electrolyte fluid between the two electrodes. This produces an electric potential between the two electrodes.

According to the teachings of the present invention, there is also provided a thin-film technology transformer including: a plurality of spiral coils arranged into two blocks. In each block the coils are arranged as a stack of at least one coil.

According to further features in preferred embodiments of the invention described below, the wireless projectile also includes an integral ring to facilitate launching of the wireless projectile by means of firing of the wireless projectile from a conventional firearm.

According to still further features in the described preferred embodiments, the wireless projectile of the current invention is configured to be launched by a conventional firearm. Particularly, the size, shape and weight of the projectile are similar to those of a conventional bullet and the projectile is packaged in a cartridge for launching from a gun.

According to still further features in the described preferred embodiments, the wireless projectile includes a stability wing, which creates drag, slowing the projectile and preventing impact damage to the target. The stability wing further supplies aerodynamic stability so that the ballistic of the projectile remains flat as much as possible even at reduced velocity.

According to still further features in the described preferred embodiments, the attachment mechanism of the wireless projectile remains safe from accidental deployment until the mechanism is armed. Arming of the projectile occurs upon launch.

According to still further features in the described preferred embodiments, the attachment mechanism of the projectile is triggered and deployed on proximity to the target.

According to still further features in the described preferred embodiments, the attachment mechanism of the wireless projectile is triggered upon impact of the wireless projectile with the target.

According to still further features in the described preferred embodiments, during storage of the projectile, the energy delivery subsystem of the projectile is in a non-active state in order to save charge. The energy delivery subsystem is activated upon impact of the wireless projectile with the target.

According to still further features in the described preferred embodiments, the energy delivery subsystem of the projectile includes a battery, and the battery is stored in a non-active state in order to save charge. The battery is activated upon impact of the wireless projectile with the target.

According to still further features in the described preferred embodiments, the impact reduction subsystem of the projectile includes a deformable pad. The deformable pad is located on an impact zone of the wireless projectile. Upon impact with a target, the pad deforms and spreads the energy of impact in space and time, preventing impact damage to the target.

According to still further features in the described preferred embodiments, the energy delivery subsystem of the projectile includes a thin film technology galvanic cell.

According to still further features in the described preferred embodiments, the energy delivery subsystem of the projectile includes a thin film technology transformer.

According to still further features in the described preferred embodiments, the impact reduction subsystem of the projectile includes a mobile subassembly. The mobile subassembly is not rigidly attached to the impact zone of the projectile and can move in relation to the impact zone of the projectile.

According to still further features in the described preferred embodiments, the mobile subassembly includes at least one component selected from the group consisting of the energy delivery subsystem, the attachment mechanism, a spider arm, a battery, a transformer, and a capacitor.

According to still further features in the described preferred embodiments, motion of the mobile subassembly relative to the impact zone activates a component of the system.

According to still further features in the described preferred embodiments, the projectile includes a mobile subassembly and further includes an energy absorbing connection. The energy absorbing connection cushions deceleration of the mobile subassembly and reduces the force of impact of the projectile upon a target.

According to still further features in the described preferred embodiments, the projectile includes a mobile subassembly and an energy absorbing connection. The energy absorbing connection includes a friction connector, a spring, a hydraulic shock absorber, a serrated track or a flexible latch.

According to still further features in the described preferred embodiments, the impact reduction subsystem includes a sub-projectile. The sub-projectile impacts the target separately from an impact zone on the projectile body. Thereby the mass associated with the impact zone of the projectile body is reduced (because the projectile body does not include those components mounted in the sub-projectile; therefore their mass does not contribute to the force of impact of the projectile body). Thereby reducing the momentum associated with the impact zone, which reduces impact damage to the target.

According to still further features in the described preferred embodiments, the projectile includes a sub-projectile. The sub-projectile is connected to the projectile body and the impact zone of the projectile body by a wire. Upon impact of the projectile body upon the target, the wire wraps around the target thereby securing the impact zone to the target at a first location and securing the sub-projectile to the target at a second location.

According to still further features in the described preferred embodiments, the energy delivery subsystem of the projectile produces an electrical potential. The electrical potential is applied as a voltage difference between the impact zone of the projectile body and a sub-projectile such that when the impact zone is near the target at a first location and the sub-projectile is near the target at a second location, electrical energy passes through the target as an electrical current from the first location to the second location.

According to still further features in the described preferred embodiments, the attachment mechanism of the projectile further serves as a conduit to transfer the energy from the energy delivery subsystem to the target.

According to still further features in the described preferred embodiments, the attachment mechanism of the projectile is an electrode and further serves as a conduit to transfer electrical energy from the energy delivery subsystem to the target.

According to still further features in the described preferred embodiments, the attachment mechanism of the projectile includes a barbed hook.

According to still further features in the described preferred embodiments, the attachment mechanism includes: a first barbed hook and a second barbed hook. The first barbed hook engages the target at a first angle and said second barbed hook engages the target at an opposing angle. Thus the two barbed hooks grasp and entangle the target.

According to still further features in the described preferred embodiments, the attachment mechanism includes a spider arm.

According to still further features in the described preferred embodiments, the attachment mechanism includes a spider arm and the spider arm springs out from the side of the wireless projectile.

According to still further features in the described preferred embodiments, the attachment mechanism includes a spider arm and a mobile subassembly. The mobile subassembly is mobile in relation to an impact zone of the projectile. Motion of the mobile subassembly relative to the impact zone serves to embed the spider arm into the target.

According to further features in the described preferred embodiments, the separator substrate of the galvanic cell has a thickness of less than 50 μm.

According to still further features in the described preferred embodiments, the electrodes of the galvanic cell each have a thickness of less than 100 μm.

According to still further features in the described preferred embodiments, the separator substrate of the galvanic cell is a dielectric when in a dry state.

According to still further features in the described preferred embodiments, the galvanic cell is activated at the time of use by applying the electrolyte fluid to the separator substrate.

According to further features in the described preferred embodiments, the thin film technology transformer includes a first spiral coil, which is a right hand coil and a second spiral coil, which is a left hand coil. The right and left hand coils are connected in an alternating sequence so that the current revolves are the center axis of the transformer in a consistent direction, thus producing a coherent magnetic field.

According to still further features in the described preferred embodiments, each spiral coil of the thin film transformer includes an isolator substrate and a conductor. The conductor is deposited on the isolator substrate in the form of a spiral.

According to still further features in the described preferred embodiments, the isolator substrate of the thin film transformer has a thickness of less than 30 μm.

According to still further features in the described preferred embodiments, the conductor of the thin film transformer has a thickness of less than 50 μm.

According to still further features in the described preferred embodiments, the thin film technology transformer is configured for optimum voltage conversion over a predetermined time-span.

BRIEF DESCRIPTION OF THE DRAWINGS

The invention is herein described, by way of example only, with reference to the accompanying drawings, where.

DESCRIPTION OF THE PREFERRED EMBODIMENTS

The principles and operation of a non-lethal wireless stun projectile system according to the present invention may be better understood with reference to the drawings and the accompanying description.

Figure 1:
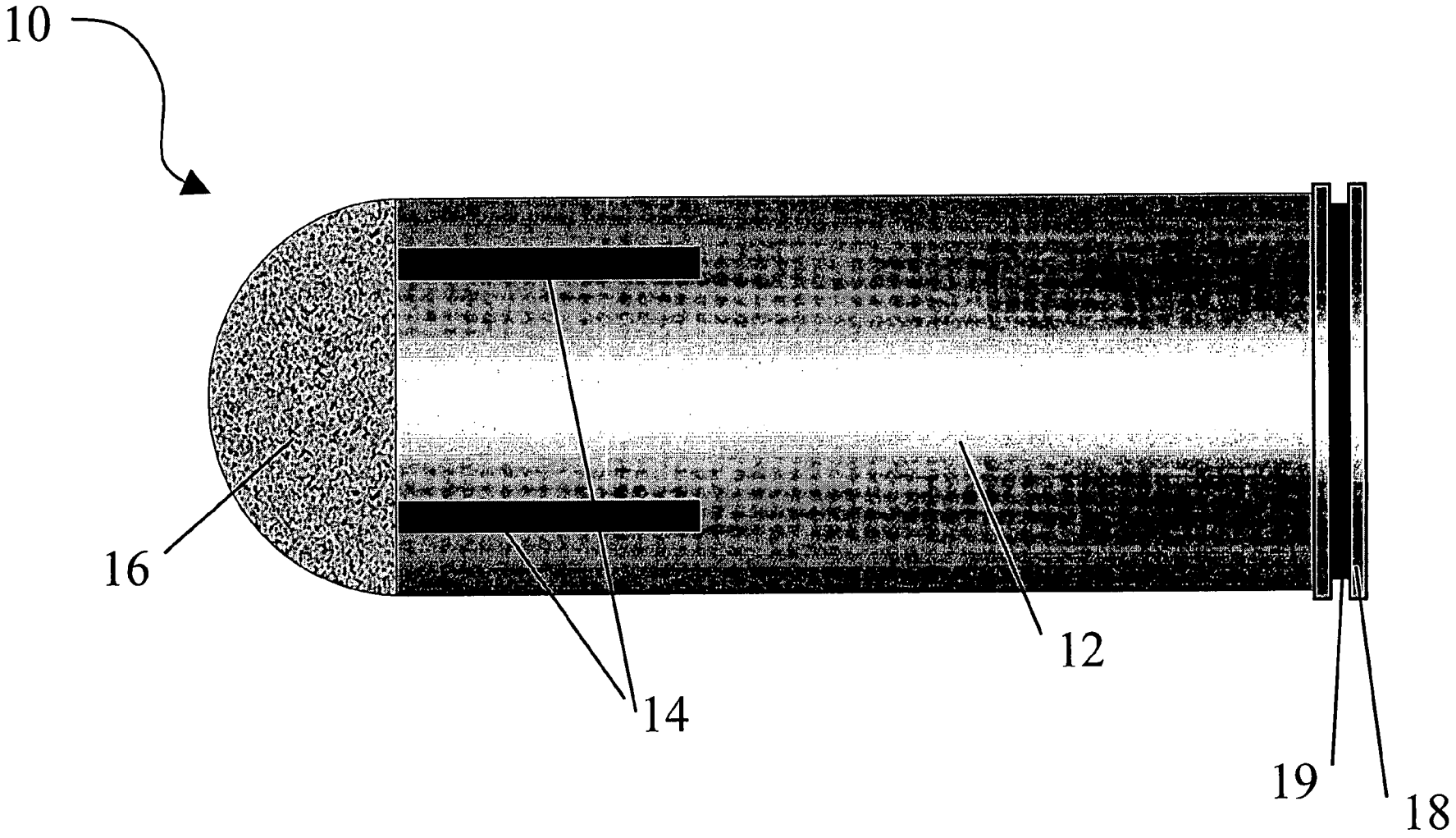
FIG. 1 is an external view of a first embodiment of a stun projectile having mechanical spider arm electrodes in an unarmed state (e.g. before launch)
Figure 2:
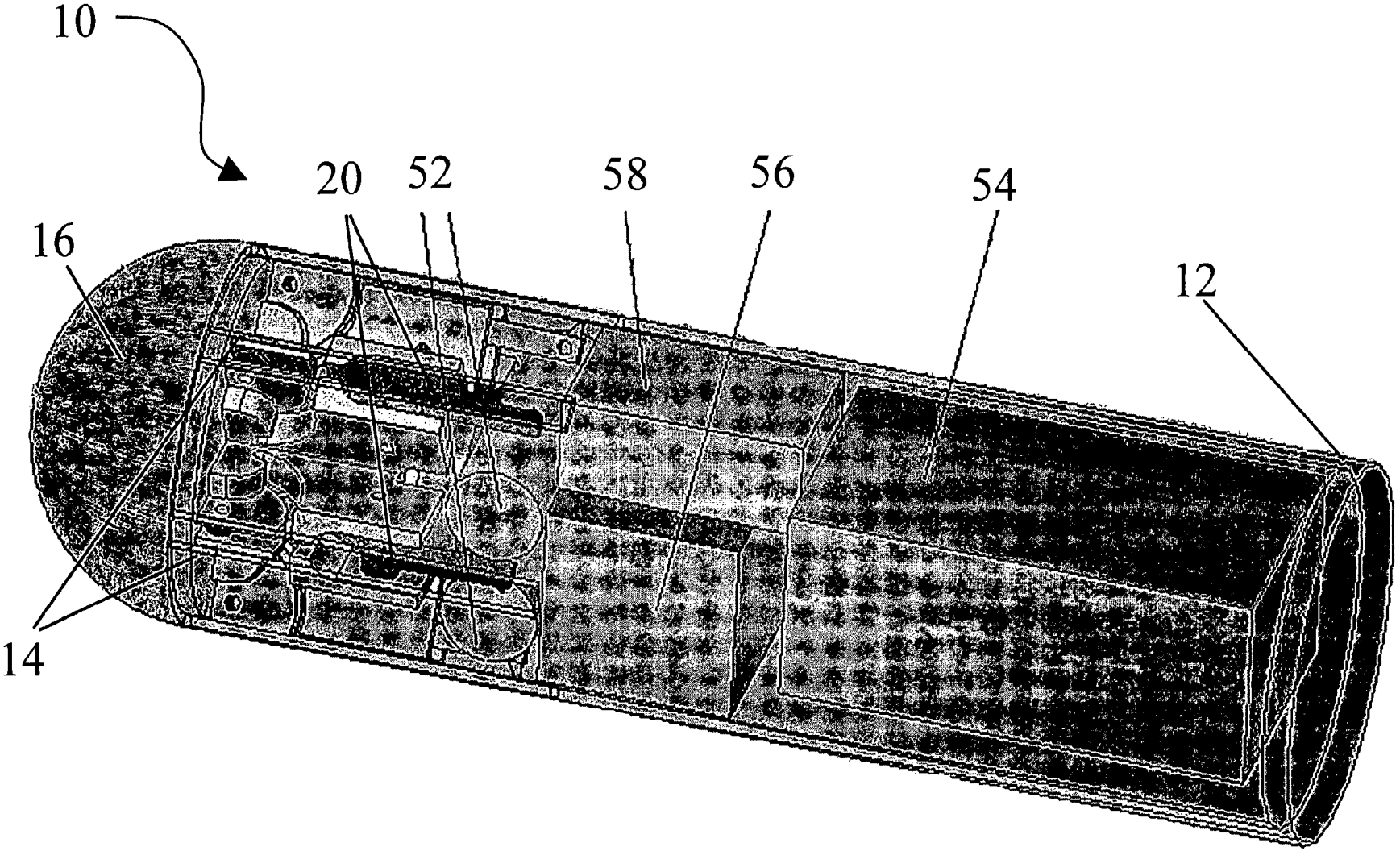
FIG. 2 is a cutaway view of the first embodiment of a stun projectile in the unarmed state.
Figure 3:
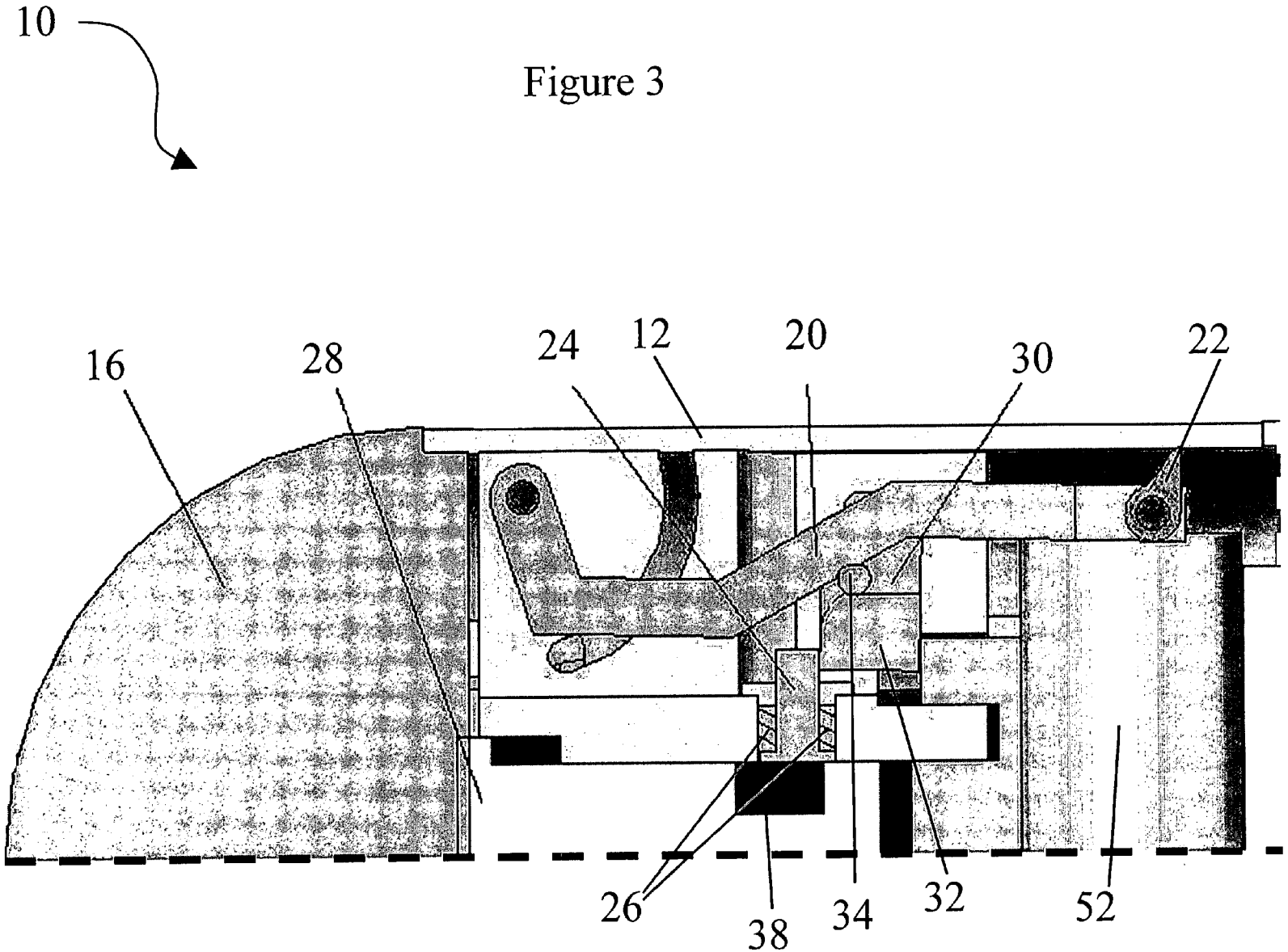
FIG. 3 is a close-view of the mechanical subsystem of the first embodiment of a stun projectile in the unarmed state (e.g. during storage and loading into a weapon)

FIG. 1 shows an external view of a first embodiment 10 of a stun projectile according to the present invention. FIGS. 1, 2 and 3 show embodiment 10 in an unarmed state. In the unarmed state, the projectile can be safely handled safely and will not be set off even under moderate stress, for example dropping the projectile from a height of 1.5 meters. The stun projectile is loaded into a conventional firearm for launch while in the unarmed state. The projectile and particularly the attachment mechanism remain unarmed until launch (for example being fired from a gun) at which time the acceleration of launch causes arming the projectile and the attachment mechanism (see FIGS. 3, 4, and 5 with accompanying description). Embodiment 10 is built of two main subassemblies a mechanical subassembly (see FIGS. 1, 2, 3, 4 and 5)

and an electrical subassembly (see FIGS. 2, 6, 7 and 8). The mechanical subassembly serves as an attachment mechanism to secure the projectile to the target. The electrical subassembly serves an energy delivery subsystem to deliver a pulsed electric shock to the target.

Shown in the FIG. 1 is a projectile body 12. Projectile body 12 is hollow and houses the active elements of the projectile as illustrated in subsequent figures. Four slits 14, in the side of projectile body 12, serve as passageways through which spider arms 20 (see FIGS. 3, 4, and 5) spring out and are deployed upon impact. Spider arms 20 serve as an attachment mechanism, to secure the projectile to a target 40 (see FIG. 5).

Projectile 10 may be fired at a range of 10-30 meter without killing. The electrical round is quite heavy. Therefore in order to avoid permanent injury at such short ranges, impact is minimized by an impact reduction subsystem. The impact reduction subsystem acts to: 1) increase the impact area, spreading the impact energy over a wide area and 2) soften the impact by distributing the impact energy over a relatively long time. Increasing the impact area and distributing the impact over time is achieved by means of a deformable pad 16 located on the impact zone of the projectile. In embodiment 10, the preferred ballistic is a flat trajectory as much as possible, (AMAP) in order to achieve, easy aiming and better accuracy. Therefore, the impact is perpendicular and the impact zone is the front of the projectile (marked by deformable pad 16).

Deformable pad 16 collapses and flattens on impact thus spreading the impact energy on larger area and spreading the impact energy over a larger time (required for deformable pad 16 to collapse) then the impact area and time of a solid bullet. Spreading the impact energy decreases the possibility of injury. To further decrease the probability of permanent injury, the impact zone in embodiment 10 is free of hard elements to eliminate any penetration possibility or "hard" impact that can cause fatal injury. The design considers maximum energy/area of 30 Joule/cm$^2$ should not be exceeded to avoid long-term impact damage.

Also shown in FIG. 1 is an Integral ring 18 that seals and keeps the pressure in the cartridge. Integral ring 18 includes a circular groove 19 that allows the ring to expand due to the pressure while firing and to improve the sealing between the projectile and the cartridge. This effect works all along the travel of the projectile in the cartridge. Typical dimensions of the seal are 0.2 mm protruding, 1 mm thickness and 4 mm groove depth or release of material around.

FIG. 2 shows a cutaway view of embodiment 10 of a stun projectile according to the present invention. Illustrated are projectile body 12, slits 14, deformable pad 16, spider arms 20, batteries 52, a high voltage transformer 54, a low voltage transformer 56, and a capacitor 58.

FIG. 3 shows a cutaway view of the top half of the front section of embodiment 10 of a stun projectile according to the present invention in the unarmed (safe) configuration. Embodiment 10 is symmetrical; therefore the bottom half is a mirror image of the top half. Therefore, the bottom half is not shown. The mechanical assembly of the projectile can be seen including spider arm 20, barb 22, safety pin 24, safety pin release spring 26 and arming element 28. Arming element 28 has a slot 38. Also shown are spider arm catch 30, pendulum weight 32 and hinge pin 34. Spider arm 20 is held stationary by spider arm catch 30 and cannot deploy. Similarly, spider arm catch 30 is held stationary by hinge pin 34 and pendulum weight 32. In the unarmed state, pendulum weight 32 cannot swing forward because the path in front of pendulum weight 32 is blocked by safety pin 24. Also seen in FIG. 3 is battery 52, which will be described in more detail in the description associated with FIGS. 15 and 16.

Figure 4:
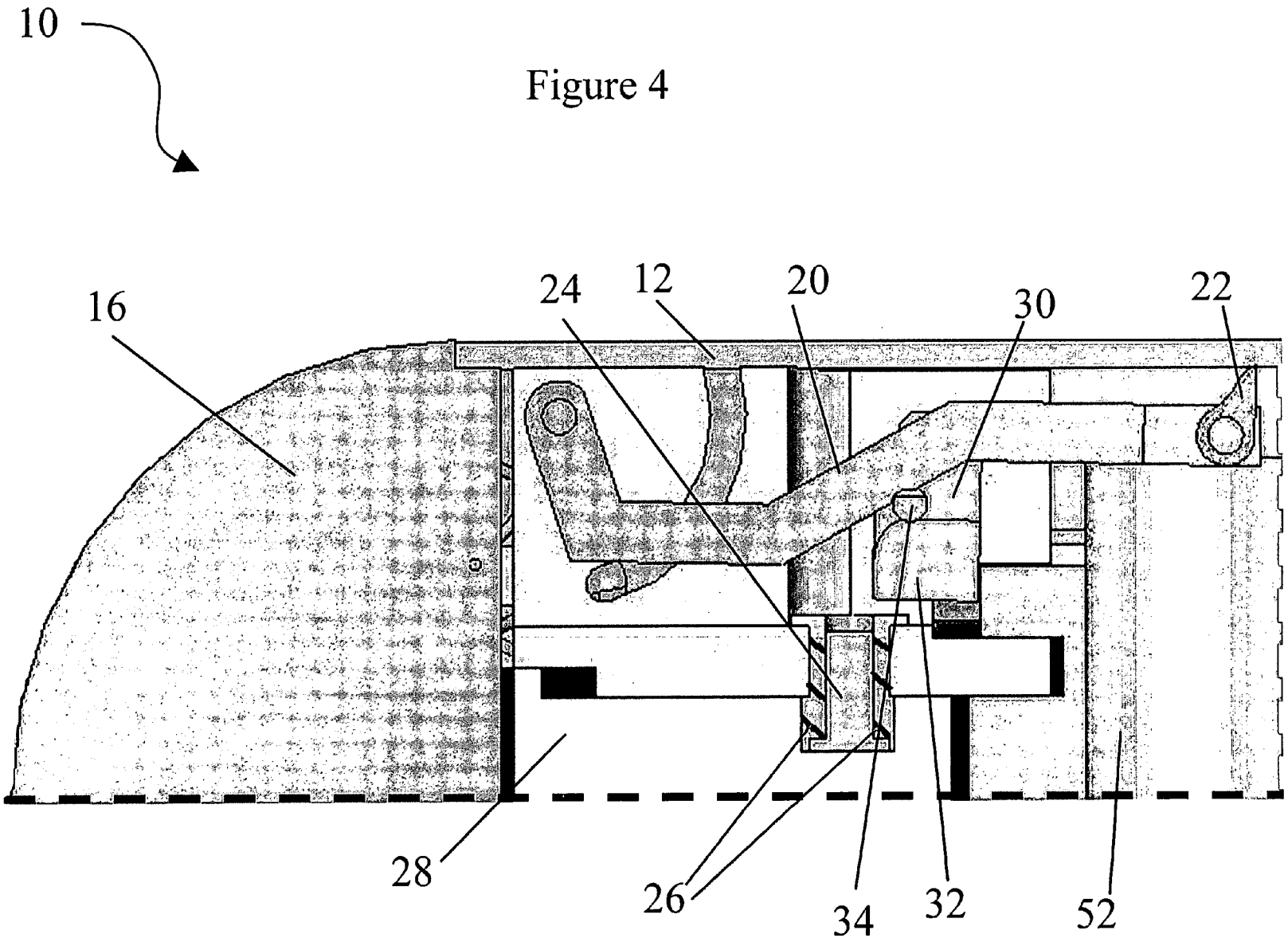
FIG. 4 is a close-view of the mechanical subsystem of the first embodiment of a stun projectile in an armed state (e.g. during flight)

FIG. 4 shows embodiment 10 in the armed state during flight. Spider arm 20 is still held stationary by spider arm catch 30. Nevertheless, in FIG. 4, the projectile of embodiment 10 is armed. Specifically at launch (shooting the bullet), inertial forces cause arming element 28 to slide backwards, lining up slot 38 in arming element 28 with safety pin 24. Then safety release spring 26 pushes safety pin 24 into slot 38. Thus, safety pin 24 no longer blocks movement of pendulum weight 32. Consequently, spider arm catch 30 and pendulum weight 32 are free to rotate around hinge pin 34.

Figure 5:
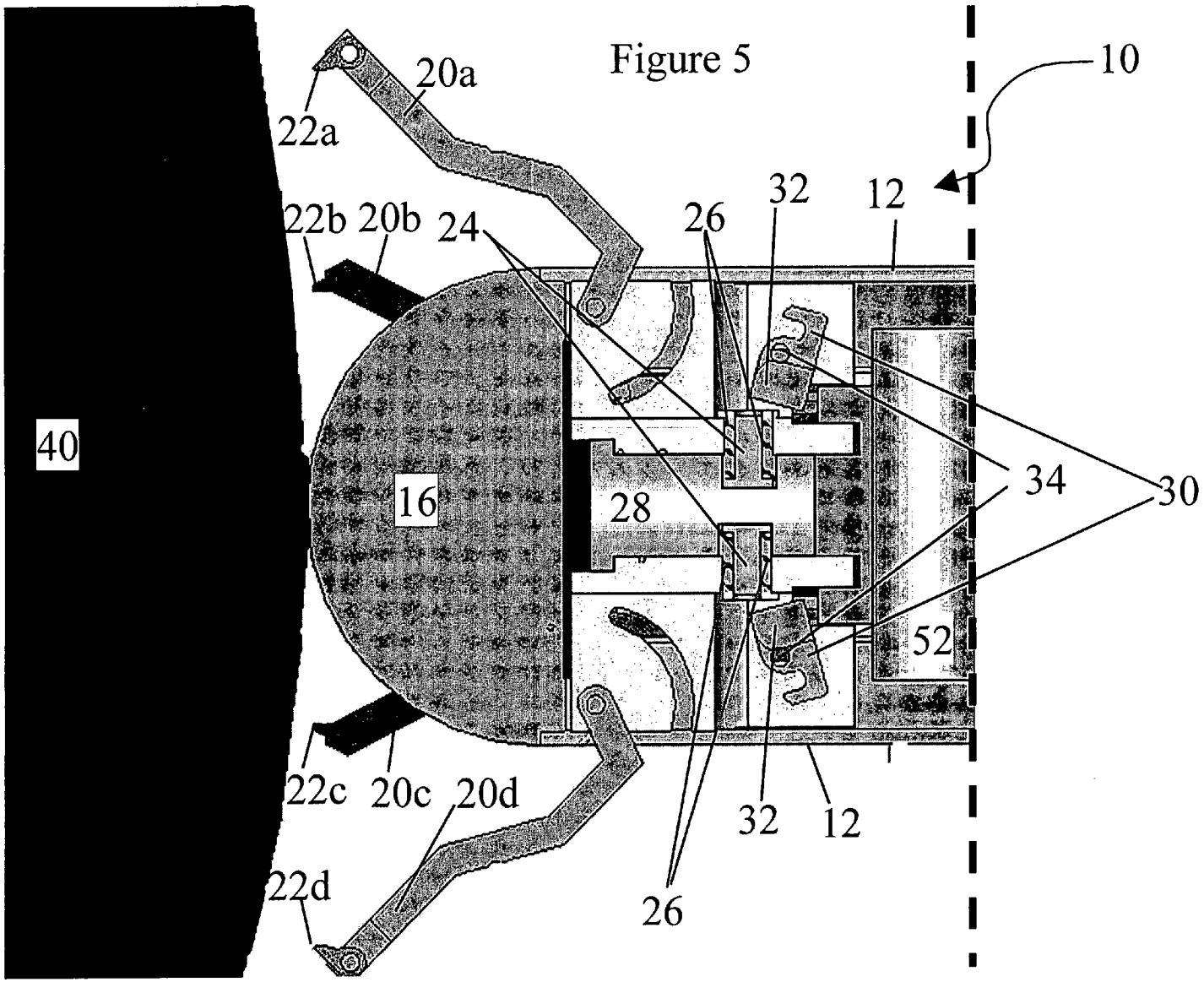
FIG. 5 is a close-view of the mechanical subsystem of the first embodiment of a stun projectile interacting with a target in an engaged state (after impact)
Figure 6:
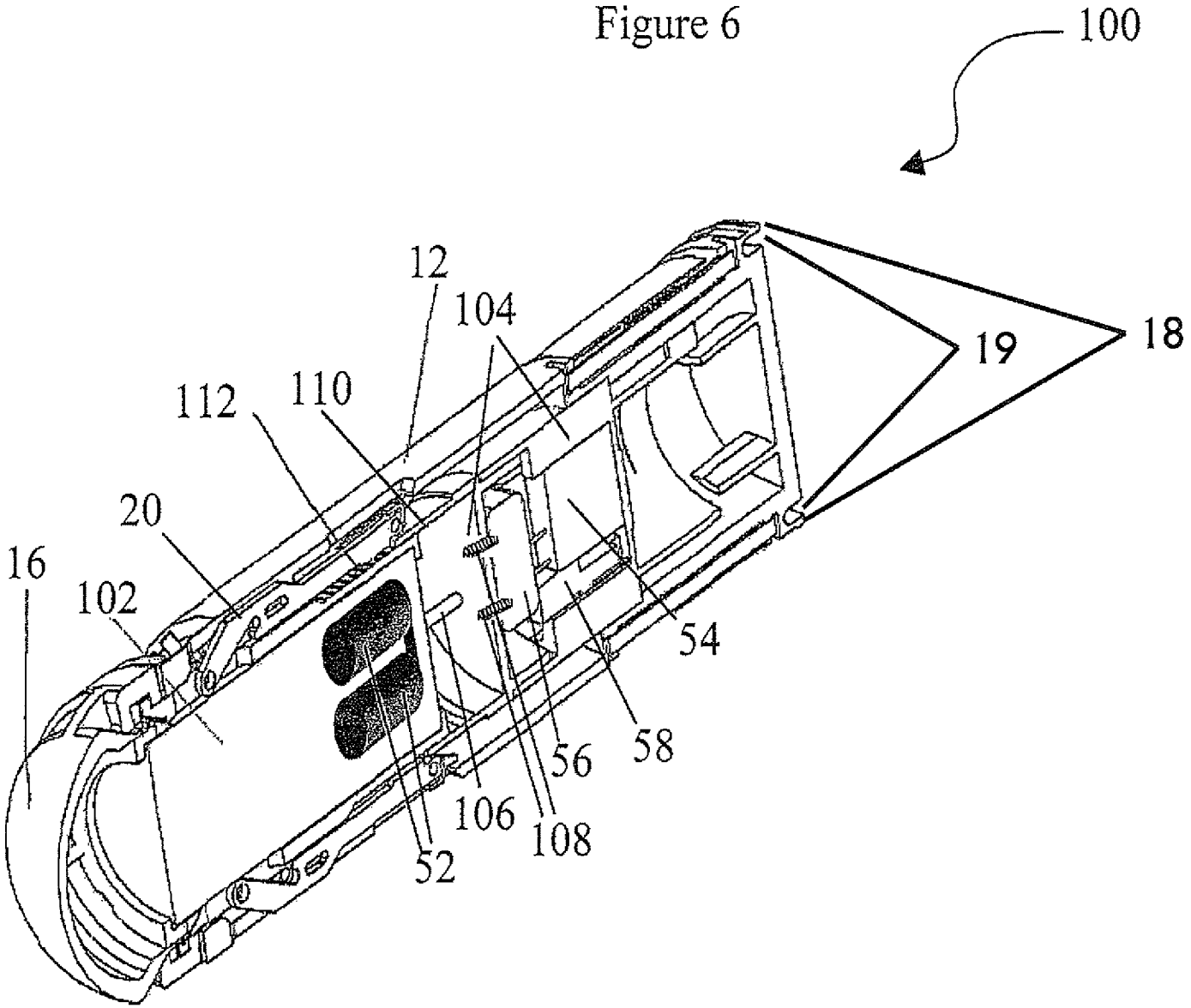
FIG. 6 is a cutaway view of a second embodiment of a stun projectile in an unarmed state; the second embodiment includes mechanical spider arm electrodes and a mobile subassembly.

FIG. 5 illustrates the stun projectile of embodiment 10 as the attachment mechanism is triggered into an engaged state. When the armed projectile of embodiment 10 (as shown in FIG. 4) impacts target 40 (as shown in FIG. 5), inertial forces push pendulum weights 32 forward causing pendulum weights 32 and spider arm catches 30 to rotate around hinge pins 34 releasing and thereby triggering spider arms 20*a-d*. Upon release, Spider arms 20*a-d* spring out of the sides of the projectile through slits 14 to engage target 40, attaching the projectile to target 40.

The attachment mechanism of the projectile of embodiment 10 includes four spider arms 20*a*, 20*b*, 20*c*, 20*d*, each with a corresponding barb 22*a*, 22*b*, 22*c*, and 22*d*. Due to the semicircular trajectory of spider arms 20*a-d*, each arm engages target 40 at a different angle. Barbs 22*a-d* are thin and sharp. Therefore barbs 22*a-d* and consequently spider arms 20*a-d* penetrate clothes skin and other materials, hooking into the flesh of target 40 to bind target 40 preventing target 40 from releasing himself from the projectile of embodiment 10. Particularly, spider arm 22*a* engages the target at a first angle and spider arm 22*c* engage target 40 at an opposing angle. Similarly spider arms 22*b* and 22*d* engage target 40 in opposite directions. It will be understood to one skilled in the art of non-lethal weapons, that because barbs 22*a* and 22*c* engage target 40 from opposing sides and in opposing directions they grasp, entangle and hook target 40, attaching the projectile to target 40 and making it exceedingly difficult for target 40 to disentangle himself from the projectile of embodiment 10. The same effect is achieved by the opposing barbs 22*b* and 22*d*. Because spider arms 20*a-d* approach the target in a semi-circular arc from outside the edges of the projectile, spider arms 20*a-d* do not interfere with front impact zone of deformable pad 16 that is deformed during impact.

Impact also initiates the electrical subsystem of the stun projectile. The electrical subsystem is not shown in embodiment 10, but is illustrated in embodiment 100, FIG. 6. The electrical subsystem is also the energy delivery subsystem for delivering electrical shocks to the target. The energy delivery subsystem of embodiment 100 includes batteries 52 to supply electrical energy, an oscillator (not shown) to convert energy from batteries 52 from direct current to alternating current. The energy delivery subsystem also includes spring electrodes 108 to transfer the alternating electrical current to low voltage transformer 56. The energy delivery subsystem also includes a high voltage transformer 54 to transform pulses of low voltage current from low voltage transformer 56 to high voltage pulses of current. In this process of transformation, low voltage AC current is rectified and is stored on a capacitor 58. Capacitor 58 is discharged through high voltage transformer 54, in which the low-voltage pulse is transformed to high-voltage pulse. The last links in the energy delivery subsystem are spider arms 20, which serve as electrodes transferring charge from high voltage transformer 54 to a target 40.

Specifically, embodiment 100 (FIG. 6) includes a rigidly mounted subassembly 102 rigidly connected to projectile body 12. Rigidly mounted subassembly 102 includes mechanical elements (not shown) and batteries 52. A mobile subassembly 104 slides along a guide rod 106. Thus mobile subassembly 104 can move in relation to projectile body 12 and in relation to the impact zone of the projectile (deformable pad 16). Mobile subassembly 104 includes high voltage transformer 54, low voltage transformer 56, capacitor 58 and spring electrical contacts 108. Mobile subassembly 104 also includes a flexible latch 110. As mobile subassembly 104 slides along guide rod 106, flexible latch 110 slides along a serrated track 112 slipping in and out of serrations thus absorbing energy.

When the projectile of embodiment 100 impacts a target (not shown), deformable pad 16 is quickly crushed and projectile body 12 and rigidly mounted subassembly 102 decelerate abruptly. On the other hand, mobile subassembly 104 continues to travel forward, sliding along guide rod 106 towards rigidly mounted subassembly 102. Mobile subassembly 104 is decelerated by the energy absorbing connection between flexible latch 110 and serrated track 112. Therefore, the rate of deceleration of mobile mounted subassembly 104 is less than the rate of deceleration of projectile body 12 and rigidly mounted subassembly 102. It is understood by one skilled in the art of momentum absorbing devices that force of impact is proportional to the rate of deceleration and mass being decelerated. Therefore, by mounting mobile subassembly 104 on an energy-absorbing track, the force of impact of the projectile of embodiment 100 on a target is significantly lessened. This decreases the probability that the target will suffer impact damage. Thus, mobile subassembly 104, spring electrical contacts 108, flexible latch 110 and serrated track 112 along with deformable pad 16 are all included in the impact reduction subsystem of embodiment 100.

Figure 7:
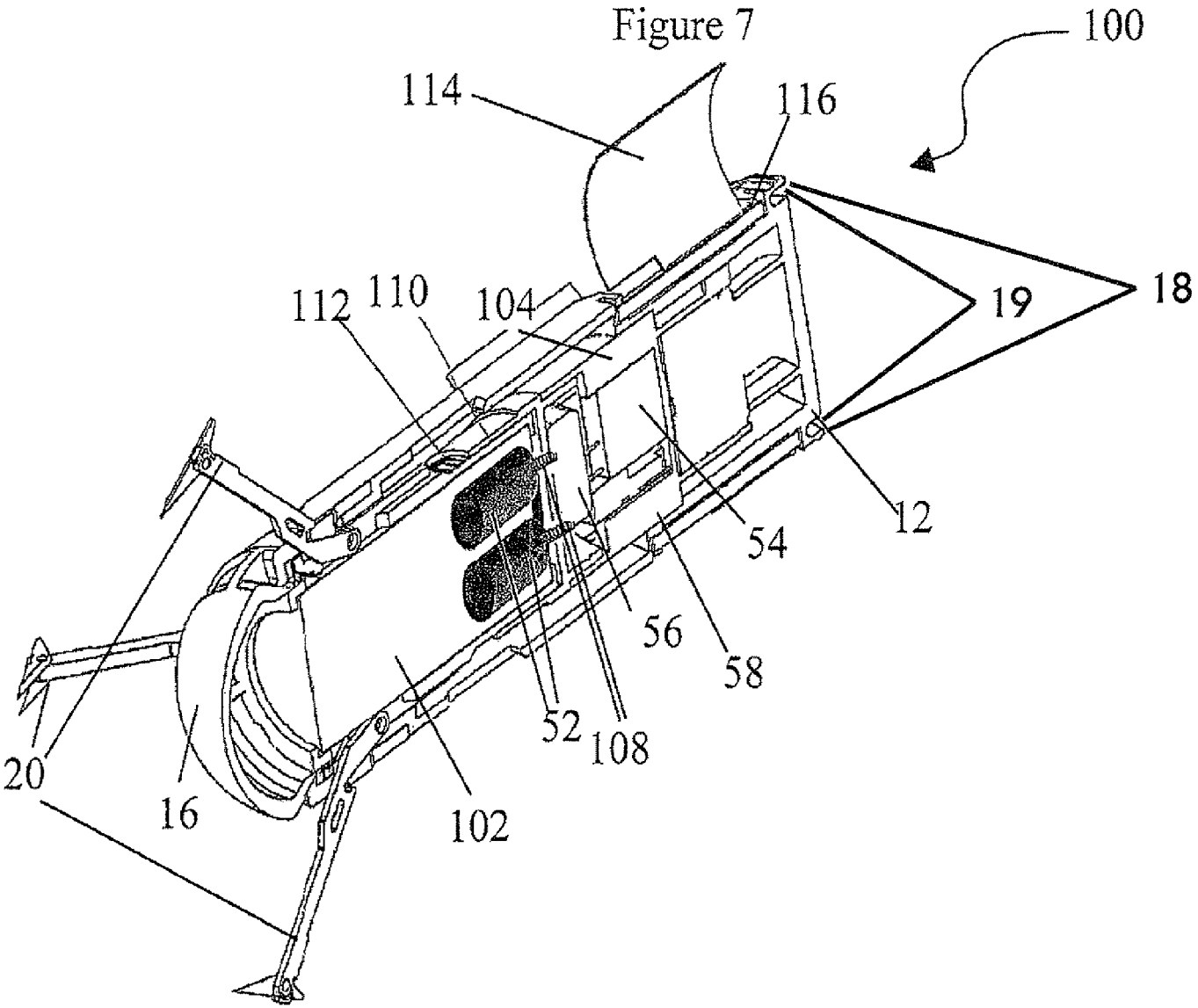
FIG. 7 is a cutaway view of the second embodiment of a stun projectile in the engaged state.

Upon impact of the projectile of embodiment 100 with a target, inertial forces causes mobile subassembly 104 to slide forward along guide rod 106. Soon after impact between the projectile of embodiment 100 and the target, mobile subassembly 104 slides to the end of guide rod 106. Then mobile subassembly 104 collides with rigidly mounted subassembly 102. Collision with mobile subassembly 104 pushes activator button 602 (see FIG. 16) activating batteries 52. Subsequently, in the absence of extreme inertial forces (on the order of the inertial forces of launch and impact of the projectile), mobile subassembly 104 is held together with rigidly mounted subassembly 102 by the force of the connection between flexible latch 110 and serrated track 112 as is shown in FIG. 7. While mobile subassembly 104 and rigidly mounted subassembly 102 are held together, spring electrical contacts 108 connect low voltage transformer 56 via an oscillator to battery terminals 604*a* and 604*b* (see FIG. 16) (each spring electrical contact 108 connects to one battery terminal 604 on each) of batteries 52 thus supplying direct current to the oscillator supplying alternating electric current to low voltage transformer 56. Low voltage transformer 56 is electrically connected to capacitor 58, and also is in turn connected to high voltage transformer 54. Low voltage transformer 56 charges capacitor 58 to maximum. Capacitor 58 discharges through high voltage transformer 54 to spider arms 20 passing high voltage pulses of electric current through the target 40 and incapacitating the target 40. Thus, the electrical system is inactive until impact with the target when motion of the mobile subassembly 104 relative to the impact zone of the projectile causes batteries 52 to be activated and connected to low voltage transformer 56, high voltage transformer 54 and capacitor 58. It will be understood by one skilled in the art of electrical devices that prior to impact with a target (for example while the projectile is being stored and while the projectile is in flight) batteries 52 are not activated and not connected to low voltage transformer 56, high voltage transformer 54 or capacitor 58. Therefore, a maximum charge is preserved in batteries 52 during storage for maximum stunning effect upon the target upon impact.

Deceleration of mobile subassembly 104 is timed such that the collision between mobile subassembly 104 and rigidly mounted subassembly 102 occurs after the triggering, deployment and extension of spider arms 20 (see FIG. 7). At the moment of collision between mobile subassembly 104 and rigidly mounted subassembly 102, momentum from mobile subassembly 104 is transferred through rigidly mounted subassembly 102 to deployed spider arms 20. This transferred momentum drives spider arms 20 further into the target making it more difficult for the target to untangle himself from the projectile of embodiment 100.

The stun projectile of embodiment 100 has the following electrical parameters:

output voltage is 50-100 kilovolt (kV)
output current is from 1-10 microampere (μA)
pulse duration is of 10 microsecond-10 millisecond (ms)
repetition rate of 10-40 Hz
working time is from 1 to 5 minute (min).

Also shown if FIG. 7 is a stability wing 114. Stability wing 114 is mounted on a hinge 116. Hinge 116 permits stability wing 114 to be folded against projectile body 12 during storage and loading into a weapon. Stability wing 114 is held in the folded (closed) position by the cartridge of the projectile. When the projectile is launched, the projectile is freed from its cartridge, and stability fin 114 opens. In flight, stability fin 114 serves two purposes. First stability wing 114 creates drag and slows the projectile, decreasing the probability of impact damage to the target. Furthermore, due to its aerodynamic characteristics stability wing 114 increases the stability of the projectile. Thus even at low velocities, ballistic performance remains high and the trajectory remains flat AMAP.

Figure 8:
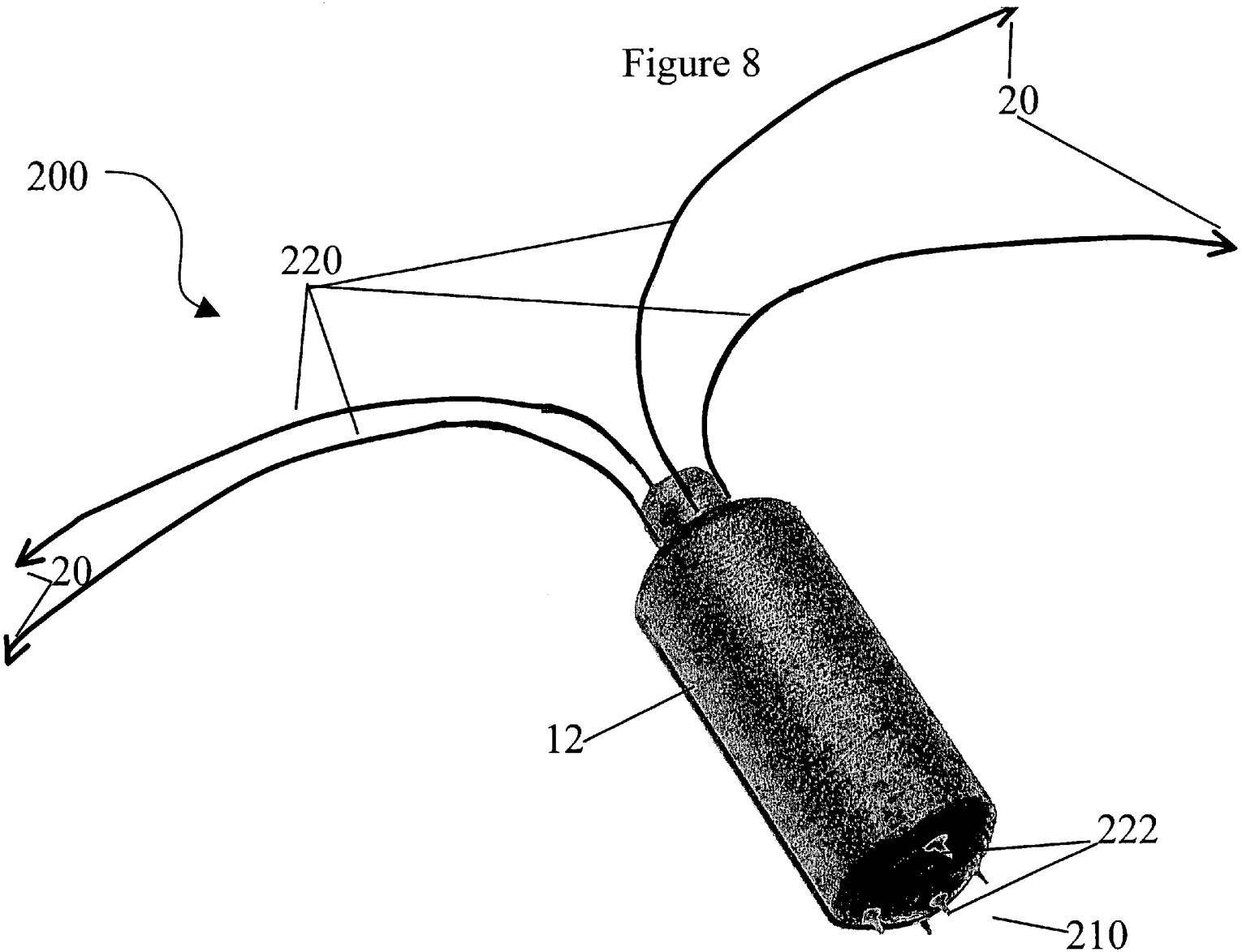
FIG. 8 is an external view of a third embodiment of a stun projectile having flexible spider arms electrodes.

FIG. 8 illustrates an alternative embodiment 200 of a stun projectile according to the present invention. Instead of a hinged spring-loaded spider arms (as in embodiments 10 and 100), the attachment mechanism of embodiment 200 includes flexible spider arms 220 made of flexible wire. When the impact zone 210 of the stun projectile of embodiment 200 impacts a target (not shown), inertial forces cause flexible spider arms 220 to bend towards the target and those forces further drive barbs 22 at the ends of flexible spider arms 220 into the target. Except for the mechanics of spider arms 220, the stun projectile of embodiment 200 works in a similar manner to the stun projectiles of embodiments 10 and 100. When flexible spider arms 220 are in contact with the target, they act as an electrode disabling the target by passing high voltage current into the target. Because flexible spider arms 220 do not include moving parts, they can be produced more cheaply than spider arms 20 of embodiments 10 and 100. The stun projectile of embodiment 200 also includes hooks 222 on impact zone 210 of the projectile. Hooks 222 are short and do not penetrate through clothing into a human, but hooks 222 are designed to fasten themselves onto clothing holding the projectile to the target. In the projectile of embodiment 200, electrical potential is applied across opposing flexible spider arms 220 (thus some of flexible spider arms 220 have a positive electrical potential and others of flexible spider arms 220 have a negative electrical potential. The potential difference drives electrical energy [current] through the target from between positively and negatively charged flexible spider arms 220 similar to embodiment 10 FIG. 5). Alternatively, positive potential can be applied to hooks 222 and negative potential to spider arms 220. Thus current passes through the target between spider arms 220 to hooks 222.

Figure 9:
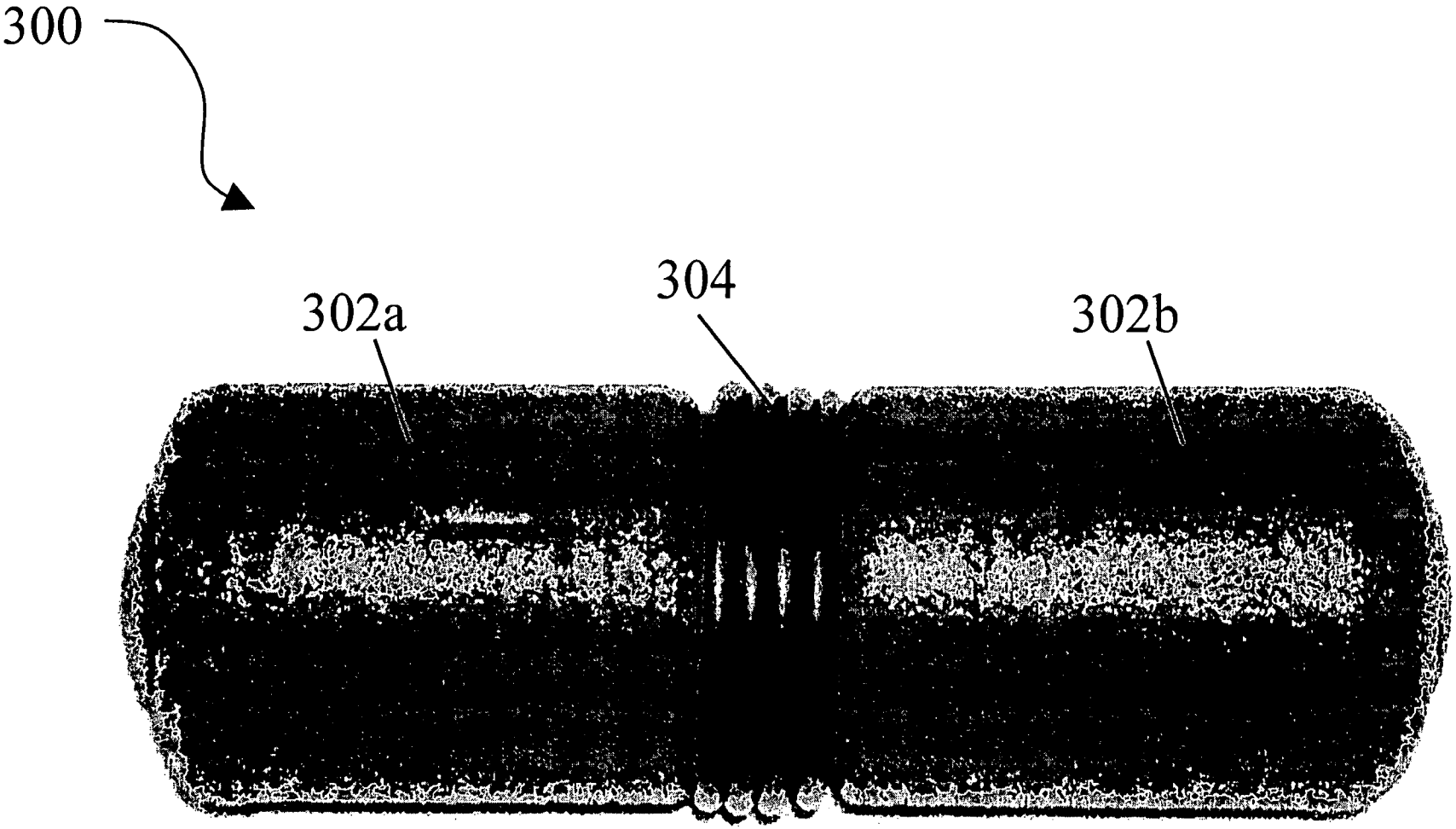
FIG. 9 is an external view prior to launch of a fourth embodiment of a stun projectile consisting of two sub-projectiles.

FIG. 9 illustrates a stun projectile according to another embodiment 300. The stun projectile of embodiment 300 is shown in FIG. 9 before launch. Shown are sub-projectiles 302*a* and 302*b*. A high voltage wire 304 connects sub-projectiles 302*a* and 302*b*. Before launch, high voltage wire 304 is wound up and inserted into a unified capsule along with sub-projectiles 302*a* and 302*b* as shown in FIG. 9.

Figure 10:
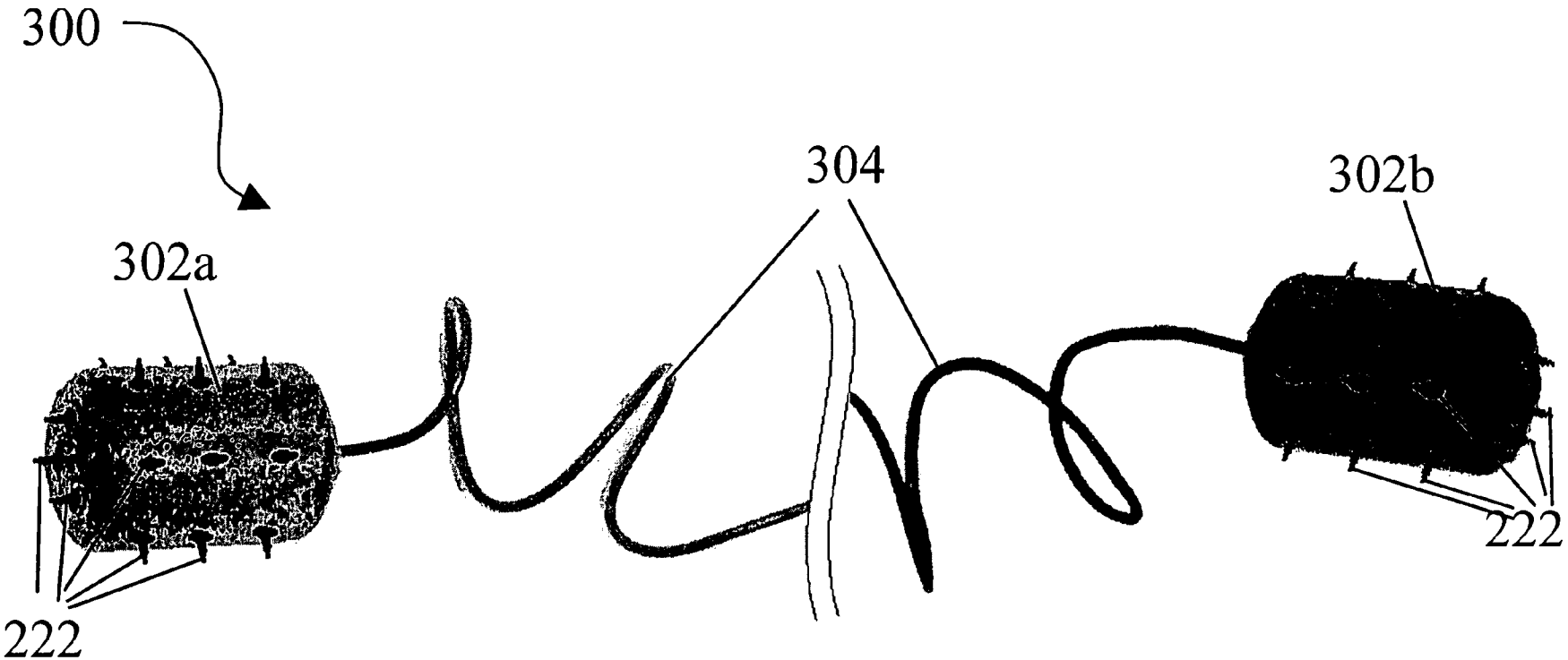
FIG. 10 is an external view of the fourth embodiment of a stun projectile during flight.

Upon launch the capsule falls away revealing (FIG. 10) the impact zone of sub-projectile 302*a*. The impact zone is the exterior of sub-projectile 302*a* and contains hooks 222, which are designed hold human clothing. Due to elastic properties of high-voltage wire 304, sub-projectiles 302*a* and 302*b* move apart to distance limited by the length of high voltage wire 304 (10-50 cm). Each sub-projectile 302*a* and 302*b* rotates in space and flies toward target 40. Also upon launch, an inertial switch (not shown) turns on the electrical systems and activates the batteries (not shown) of sub-projectiles 302*a* and 302*b* (the electrical system of sub-projectiles 302*a* and 302*b* are similar to the electrical system illustrated in FIG. 2). In embodiment 300, battery 52 is contained by sub-projectile 302*a* and high voltage transformer 54, low voltage transformer 56, and capacitor 58 are all contained in sub-projectile 302*b*

Figure 11:
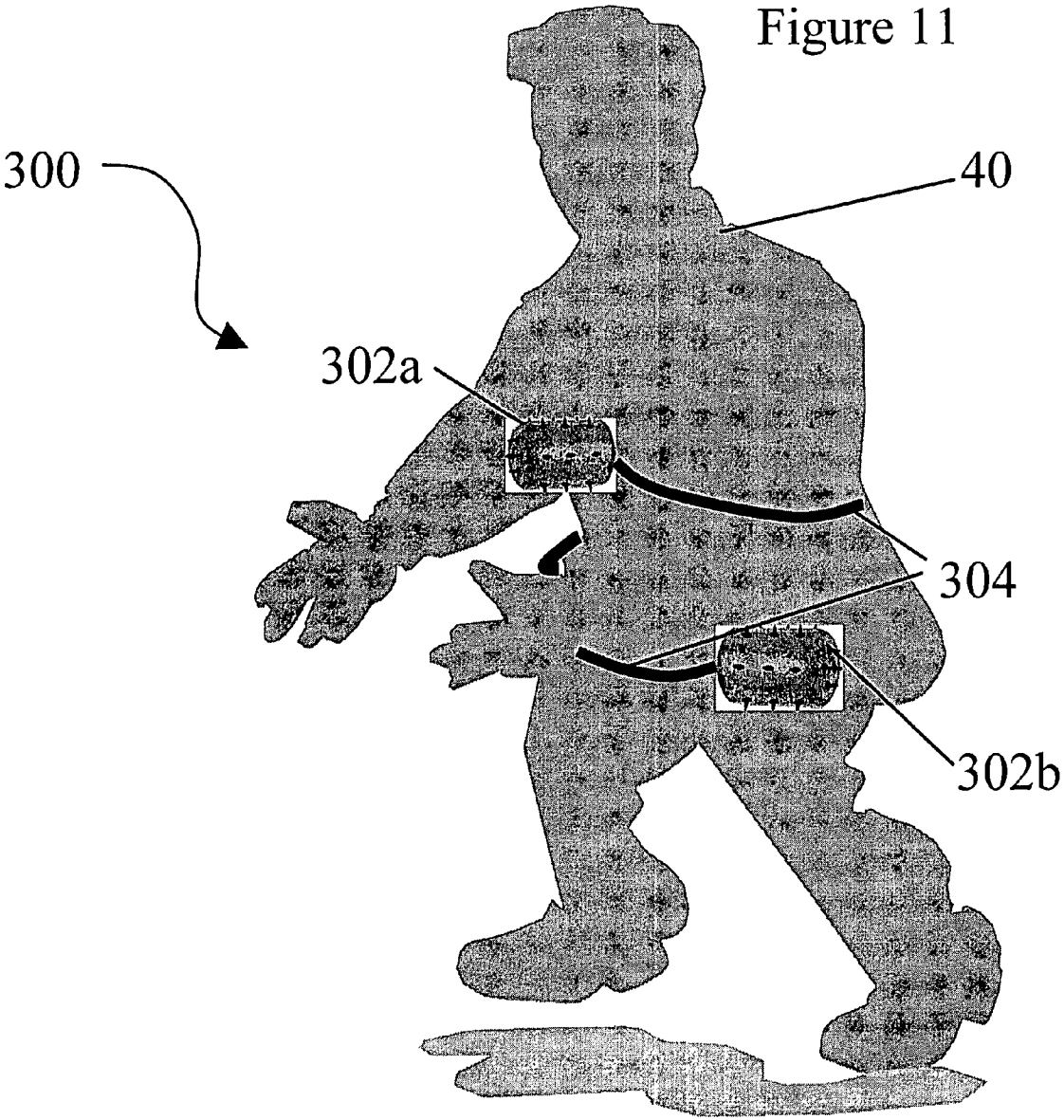
FIG. 11 is an external view of the fourth embodiment of a stun projectile engaging a target.
Figure 12:
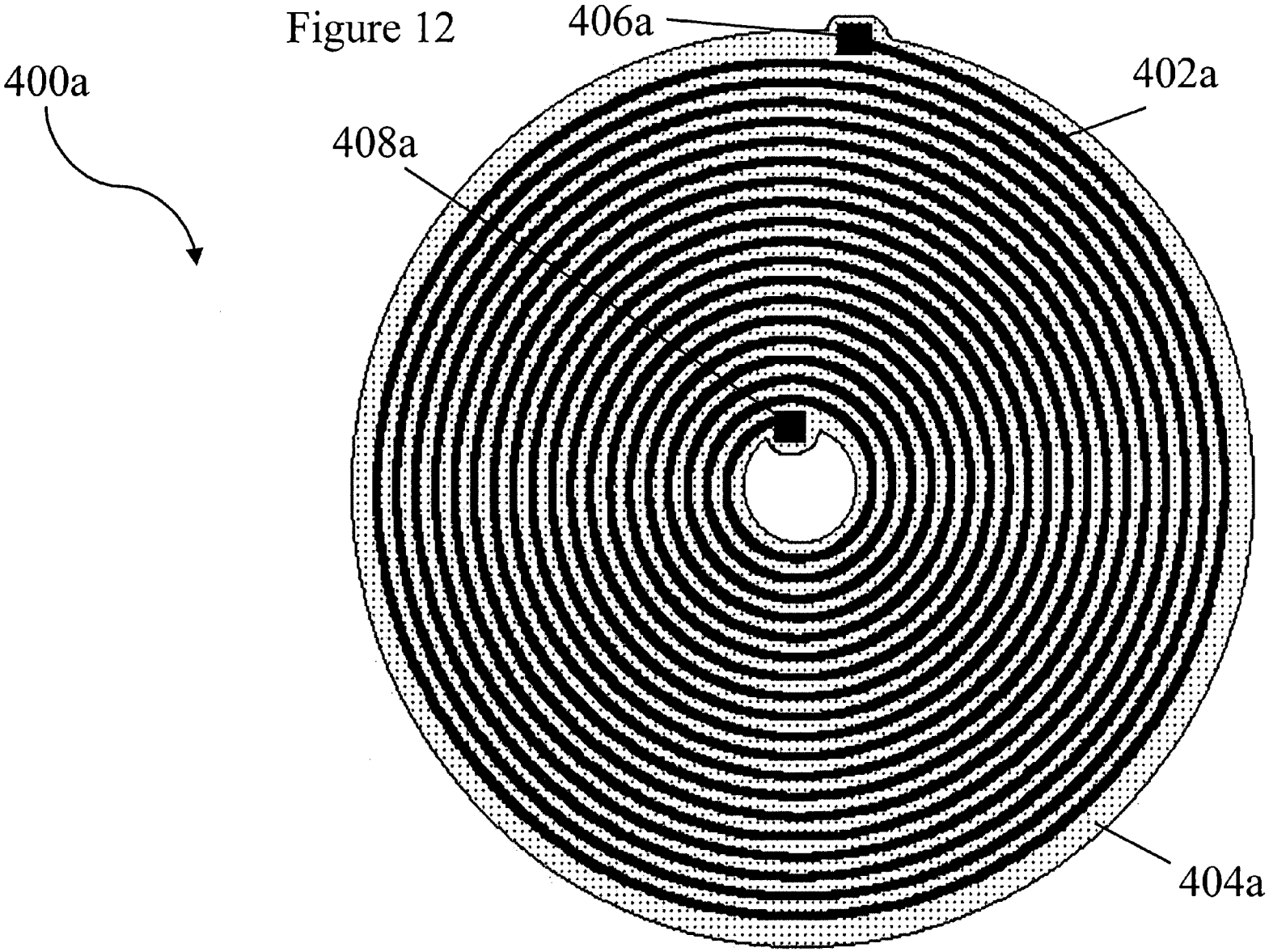
FIG. 12 is a depiction of a coil from a thin-film miniature transformer.

FIG. 11 illustrates attachment of the stun projectile of embodiment 300 to target 40. The attachment mechanism of embodiment 300 includes high voltage wire 304, which winds around target 40 and hooks 222, which stick to target 40. When the impact zone of sub-projectile 302*a* strikes target 40, hooks 222 on sub-projectile 302*a* stick to target 40. Elastic properties of high-voltage wire 304 cause the high-voltage wire 304 to wrap around target 40. Furthermore, as high-voltage wire 304 wraps around target 40, sub-projectile 302*b* impacts target 40 separately from the impact zone (of sub-projectile 302*a*). Then, hooks 222 on sub-projectile 302*b* stick to target 40. Once both sub-projectiles 302*a* and 302*b* are in proximity of target 40, the electrical potential difference between sub-projectiles 302*a* and 302*b* drives a pulsed current through target 40, stunning and disabling him. Note that because sub-projectile 302*a* contains the impact zone of the projectile, sub-projectile 302*a* is also referred to as the body of the projectile.

The advantages of embodiment 300 are:

a) The mass of the projectile is divided in two parts and therefore the force of the impact shock is decreased with respect to a monolith bullet.

b) Electrodes of embodiment 300 do not have to touch or penetrate the skin of target 40. Thus probability of significant damage to the skin of target 40 is decreased. Because the positive and negative electrodes (on sub-projectile 302*a* and 302*b* respectively) are separated at the range of 10-50 cm, high voltage current will pass through and affect target 40 even when the electrodes are separated from the skin of target 40 by clothes and an air gap.

c) Embodiment 300 requires fewer hooks to hold back the shocker at the surface of interaction than embodiments 10, 100 and 200.

d) The necessity to hold back a bullet only at the clothes, not at the human body, leads to decrease of dimensions of hooks, which finally decreases potential damage caused by hooks on the human tissue if the projectile impacts target 40 near a sensitive spot.

e) Dividing a bullet at two parts (or more) can increase the rifle sight range.

Producing an electric shock that will incapacitate an adult human being for 5 minutes using a mechanism the size of standard ammunition requires that the electrical components (battery 52, high voltage transformer 54, low voltage transformer 56, and capacitor 58) be smaller and more efficient than those currently available. In the present invention, miniature electrical components are produced using novel applications of thin film technology.

High-voltage transformer 54 is produced using thin-film technology. FIG. 7 illustrates a spiral coil 400*a* component of a thin film transformer. A conductor 402*a* for current production is a thin layer of metal spreading and drifting at the surface of a film isolator substrate 404*a*. Conductor 402*a* is produced in the form of right hand spiral. On the outer end of the spiral is an outer electrode connector 406*a*. On the inner end of the spiral is an inner electrode connector 408*a*. Outer electrode connector 406*a* is open and uncovered on the upper side (facing out of the page) of spiral coil 400*a*. Inner electrode connector 408*a* is insulated from above, but open and uncovered on the underside of spiral electrode 400*a*. Thus spiral electrode 400*a* is connected to an external electrode from above via outer electrode connector 406*a*, and spiral electrode 400*a* is connected to a second external electrode from below via inner electrode connector 408*a* (see FIG. 13).

Figure 13:
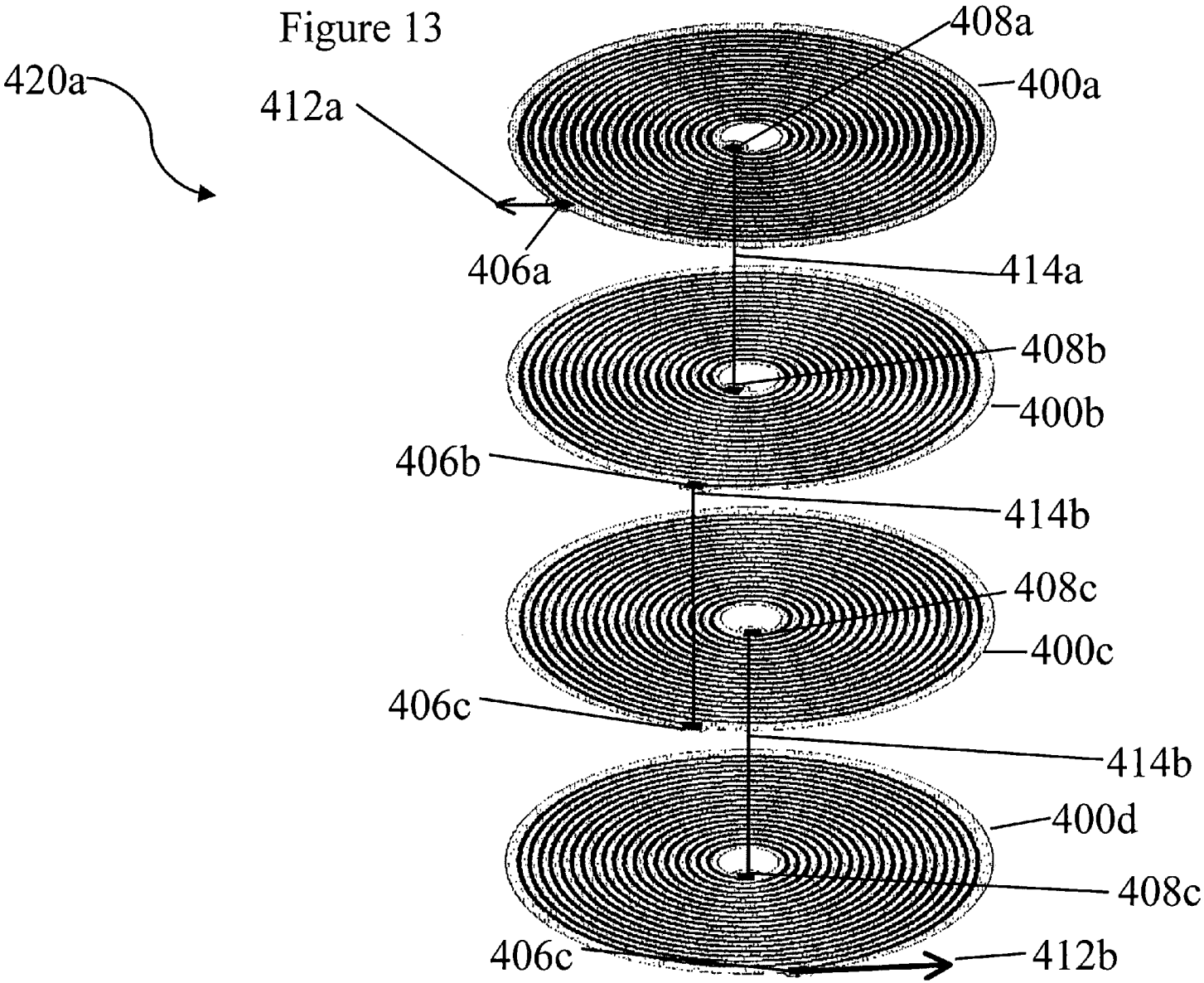
FIG. 13 is a depiction of a stack of coils forming a block from a thin film miniature transformer.
Figures 14A, 14B:
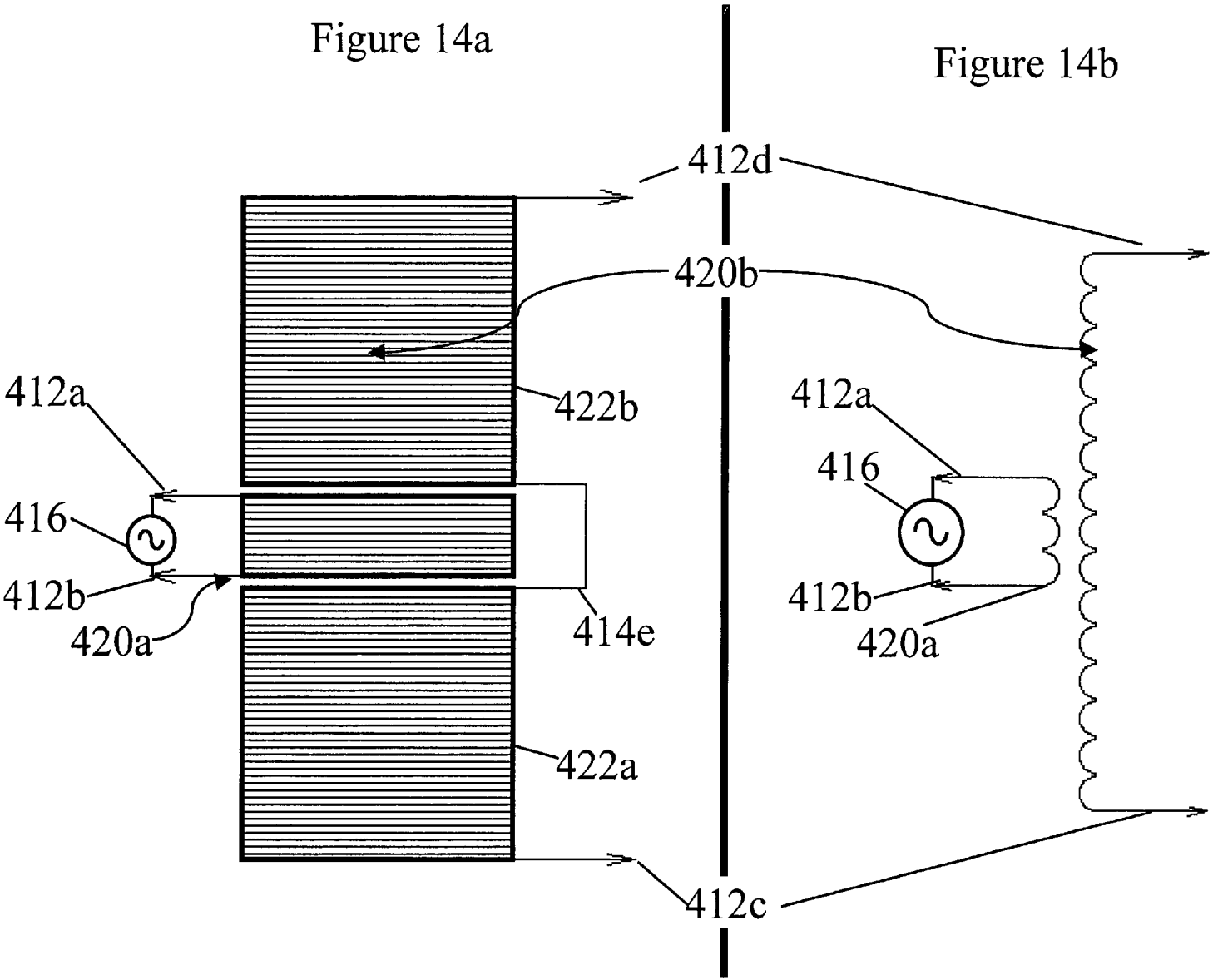
FIG. 14*a* is a depiction of a miniature thin film transformer according to the present invention.
FIG. 14*b* is a symbolic representation of the thin film transformer of FIG. 14*a;*

Illustrated in FIG. 13, a plurality of spiral coils 400*a*, 400*b*, 400*c* and 400*d* with respective conductive spiral layers 400*a*, 400*b*, 400*c* and 400*d* are assembled into a block 410*a*, which serves as windings for a transformer (see FIG. 14*a*-*b*). When an electrical potential is applied across input terminals 412*a* and 412*b*, current runs from input terminal 412*a* to outer electrode connector 406*a*. Current continues to run through conductor 402*a* spiraling rightward and inward to inner electrode connector 408*a*. Inner electrode connector 408*a* is connected via a mechanical connector 414*a* to inner electrode connector 408*b* on spiral coil 400*b*. Spiral coil 400*b* is similar to spiral coil 400*a* except that the conductor 402*b* of spiral coil 400*b* is a left hand spiral. Furthermore, on spiral coil 400*b*, inner electrode connector 408*b* is open to connections from the top of spiral coil 400*b* whereas outer electrode connector 406*b* is open to connections from the bottom of spiral coil 400*b*. Thus, current runs from inner electrode connector 408*b* spiraling rightward and outward to outer electrode connector 406*b*. It will be understood to one familiar with the art of electromagnetic devices, that since current revolves rightward in both spiral coil 400*a* and spiral coil 400*b*, both coils produce magnetic field pointed downward. Thus the magnetic fields produced by coils 400*a* and 400*b* are additive.

In a similar manner, spiral coil 400*c* is a right hand spiral exactly similar to spiral coil 400*a*. Thus, current passes from spiral coil 400*b* to spiral coil 400*c* via mechanical connector 414*b* to outer electrode connector 406*c* and spirals rightward and inward to inner electrode 408*c* further strengthening the downward magnetic field. Current continues through spiral coil 400*d* which is a left hand coil exactly similar to spiral coil 400*b*. Thus, current rotates outward and rightward to outer electrode connector 406*d* strengthening the downward magnetic field. Current passes from outer electrode connector 406*d* to terminal 412*b*.

FIGS. 14*a* and 14*b* illustrate block 410*a*, serving as primary windings of a step up transformer. Block 410*a* is connected to an alternating current source 416. Current passing through the windings of block 410*a* induces an alternating magnetic field. The magnetic field induces a current in block 410*b*. Block 410*b* is a stack of alternating right and left spiral coils (400 not shown) connected in series in a manner similar to block 400*a*. Block 410*b* contains 16 spiral coils (400 not shown). The coils (400) of block 410*b* are collected into two stacks 422*a* and 422*b* of 8 coils each. Stacks 222*a* and 422*b* are connected in series by mechanical connecter 414*e*. Block 410*a* is mounted in between stacks 422*a* and 422*b* such that the spiral coils 400*a*-400*d* are coaxial with the spiral coils (400) of block 410*b*. Thus when input voltage and current are applied across block 410*a* a magnetic field is produced. The magnetic field induces an electrical potential having four times the input voltage across block 410*b* (from terminal 412*c* to terminal 412*d*).

Conventional transformers need a ferrite or steel core to propagate the magnetic field from the primary windings to the secondary windings. The ferrite core adds weight to the transformer and also reduces the efficiency of the transformer. Because windings of the thin film high voltage transformer 52 of the present invention are very dense, therefore the spacing between the primary and secondary windings is small and high voltage transformer 52 has no magnetic conductor core. As a result, high voltage transformer 52 is lighter and more efficient than conventional transformers.

Because high voltage transformer 52 is for one-time use only and the working time is not to exceed 10 min, the cross-section of the current conductive layer of high voltage transformer 52 can be smaller than allowed in a conventional transformer. The thin conductive layer will lead to temporary heating of the transformer, but nevertheless, the short working life of the transformer will ensure that thermal break down does not occur. Decreasing the dimensions of the current conductive layer allows further decrease in the dimensions and weight of high voltage transformer 52 with respect to the conventional transformers.

For example one embodiment of a thin film technology transformer having input voltage 1 kV and current 1 mA and output voltage and current 100 kV and 10 ? A with a working life of 5 min is made of the following materials:

TABLE 1

| Thin Film Transformer | | | |
|---|---|---|---|
| | Thickness | Width | Material |
| Conductor | 5 μm | 0.1 mm | Aluminum |
| Isolator | 10 μm | Distance between consecutive conductor winds (revolutions) 0.1 mm | Paper |

The external diameter of each spiral coil is 12 mm and the inner diameter of each coil is 5 mm; each spiral has 10 revolutions. The transformer contains 10 spiral coils stacked in the primary winding and 1000 spiral coils stacked in the secondary winding. Thus the transformer is a cylinder of total dimensions 16 mm height and 12 mm diameter. The mass of the transformer is 10 g.

This is smaller lighter and more efficient than a conventional wire wound ferrite core transformer. In order to achieve and output voltage and current of 100 kV and 10 μA a conventional transformer requires input voltage and current of 1 kV and 1 mA and has dimensions, 23 mm diameter and 50 mm height, by weighing 40 g.

It will be understood by one skilled in the art of electrical devices, that the electrical potential (voltage drop) between adjacent spiral coils 400*a* and 400*b* is approximately one quarter the electrical potential between terminals 412*a* and 412*b*. Generally because of the stacked architecture of the spiral coils (400) in a block (410), the electrical potential between adjacent spiral coils is V/N where V is the electrical potential over the entire block and N is the number of spiral coils in the block. Because the voltage difference between neighboring spiral coils is much less than the voltage drop over the block, the potential for short-circuiting is reduced. This makes it possible to produce a very high voltage transformer without needing thick/heavy insulation between windings. This reduces the size and weight of the transformer with respect to conventional wire winding transformers.

A thin film transformer according to the present invention is smaller and lighter than a conventional transformer because:

- The thin film transformer has a higher density of winds then a conventional transformer.
- Because of the stacked structure of a thin film technology transformer, the voltage difference between adjacent windings is less than the voltage between the first and last windings (across the transformer block). Therefore, the high voltage (greater than 10 kV) thin film technology transformer requires less insulating between winds than a conventional transformer and it is not necessary to flood a high voltage thin film transformer with liquid isolating material to eliminate the short-circuit effect between windings.
- In conventional transformers, in order to facilitate propagation of the magnetic field from the primary winding to the secondary winding, it is necessary to include an iron (Ferrite/steel) magnetic core. Because of the small dimensions of the winds in a thin film transformer, the magnetic field of the primary coil propagates to the secondary coil without requiring a Ferrite core.
- We reduce the cross section of the conductive layer in comparison to conventional transformers. Even though reducing the cross sectional area of the conductive layer leads to high current densities and heating of the transformer coil, we need not worry about thermal breakdown because the transformer is for one-time, short-term use.

Other advantages of the thin film transformer of the current invention over convention transformers are: There is no need for an iron core, which reduces the efficiency of voltage transformation. The parameter of transformation of a thin film transformer can easily be varied by changing of number of spiral coils.

One skilled in the art of electronic devices will understand that many possible variations of a transformer according to the spirit of the present invention are included in this patent. Alternative conducting materials can employed in the spirals coils including, for example, cuprum, alumina, and carbon. Connection between the spirals' ends can be made by alternative methods, for example mechanical connectors or electro-conductive glue. A thin film transformer can include a magnetic ferrite core or function without ferrite. Spiral conductors can be created at the separating substrate by many methods, including spreading, chemical deposition/sedimentation, by regular typing, or other known methods. The layers of isolating substrates can be connected by glue or can be held by the outer construction of the bullet. The materials of such isolating substrates can include various isolators for example, paper and plasmas.

Typical ranges of parameters for production of a thin film technology transformer are: The insulating substrate can be from 3-50 μm thick. A single transformer will contain from 10 to 10,000 spiral coils. The height of the block of stacked spiral coils will be 10-30 mm. Output of the transformer will be 100-2000 V at 1-10 mA for a low voltage transformer and from 50-100 kV at 1-100 μA for a high voltage transformer.

Figure 15:
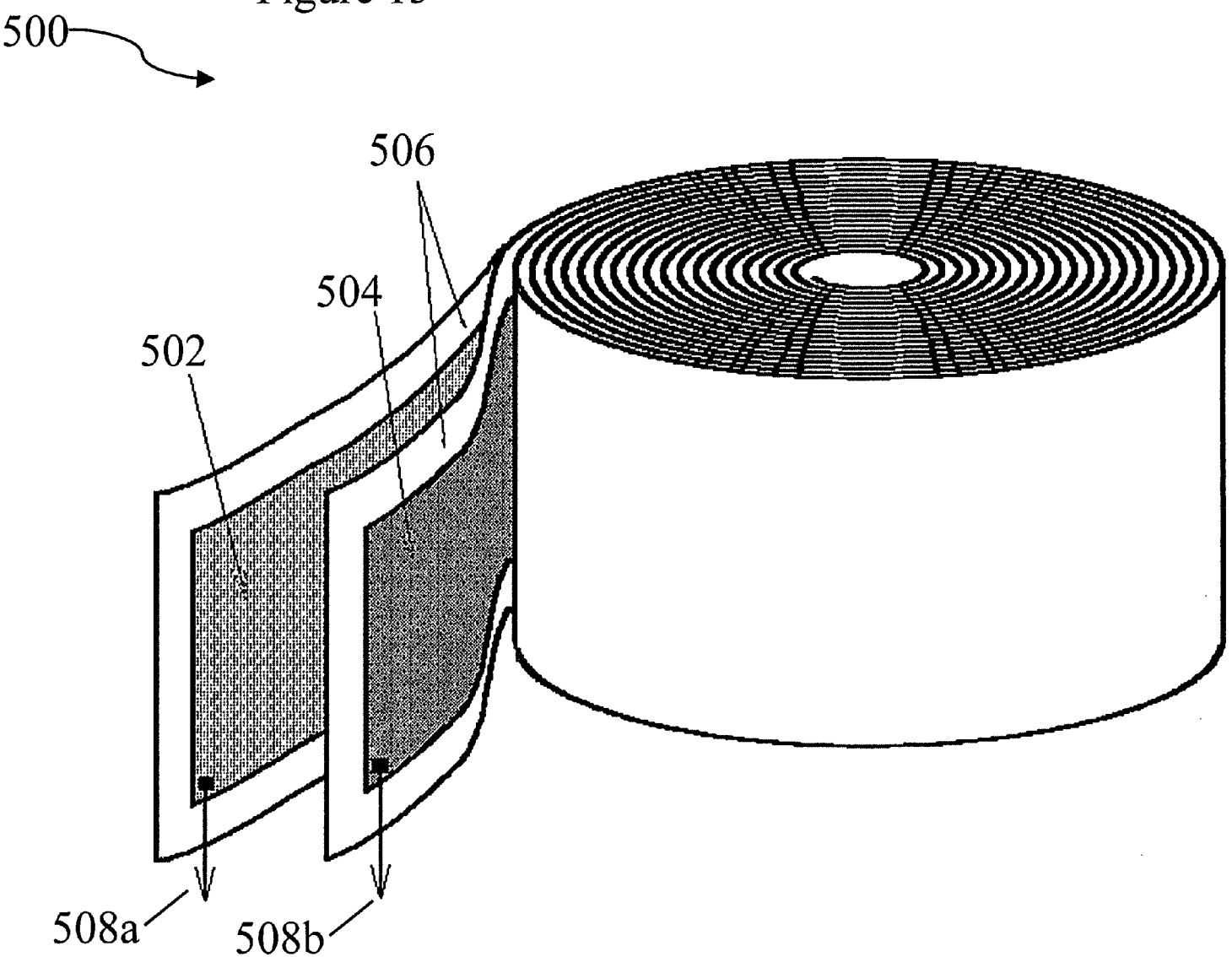
FIG. 15 is a depiction of a miniature thin film galvanic cell according to the present invention.

Illustrated in FIG. 15 is a galvanic cell 500 according to the present invention. Galvanic cell 500 is a miniature thin film technology chemical source of energy for one-time use. Electrodes (cathode, as the oxidator, 502 and anode, as the redactor, 504) are made in the form of the ensemble of solid layers as the electrode with oxidation-reduction films deposited on a separator substrate 506. Cathode 502 and anode 504 are each connected to battery terminals 604*a* and 604*b* (see FIG. 16) via a power leads 508*a* and 508*b*.

Initially, dry separator substrate 506 acts as a dielectric insulator membrane, separating between the electrodes (plus [cathode 502] and minus [anode 504]). Both cathode 502 and anode 504 are created using sprite system to create a thin layer on the surface of the separator substrate 506. Galvanic cell 500 is activated when the initially dry separator substrate 506 absorbs an electrolyte fluid 606 (see FIG. 16). Dry separator substrate 506 is strongly hydrophilic and quickly draws electrolyte fluid 606 into pores in separator substrate 506. Capillary forces quickly distribute electrolyte fluid 606 to the entire surface of both cathode 512 and anode 504. Electrolyte fluid 606 then facilitates ion transport between cathode 502 and anode 504 producing an electric potential across power leads 508*a* and 508*b* and battery terminals 604*a* and 604*b*.

Separating substrate 506 is made as a ribbon in the form of a spiral, as shown in FIG. 15. In such a manner we obtain large surface area of both cathode 502 and anode 504 in a small (low volume) galvanic cell 500. Large electrode surface area permits high current production during the short-term life of galvanic cell 500.

Figure 16:
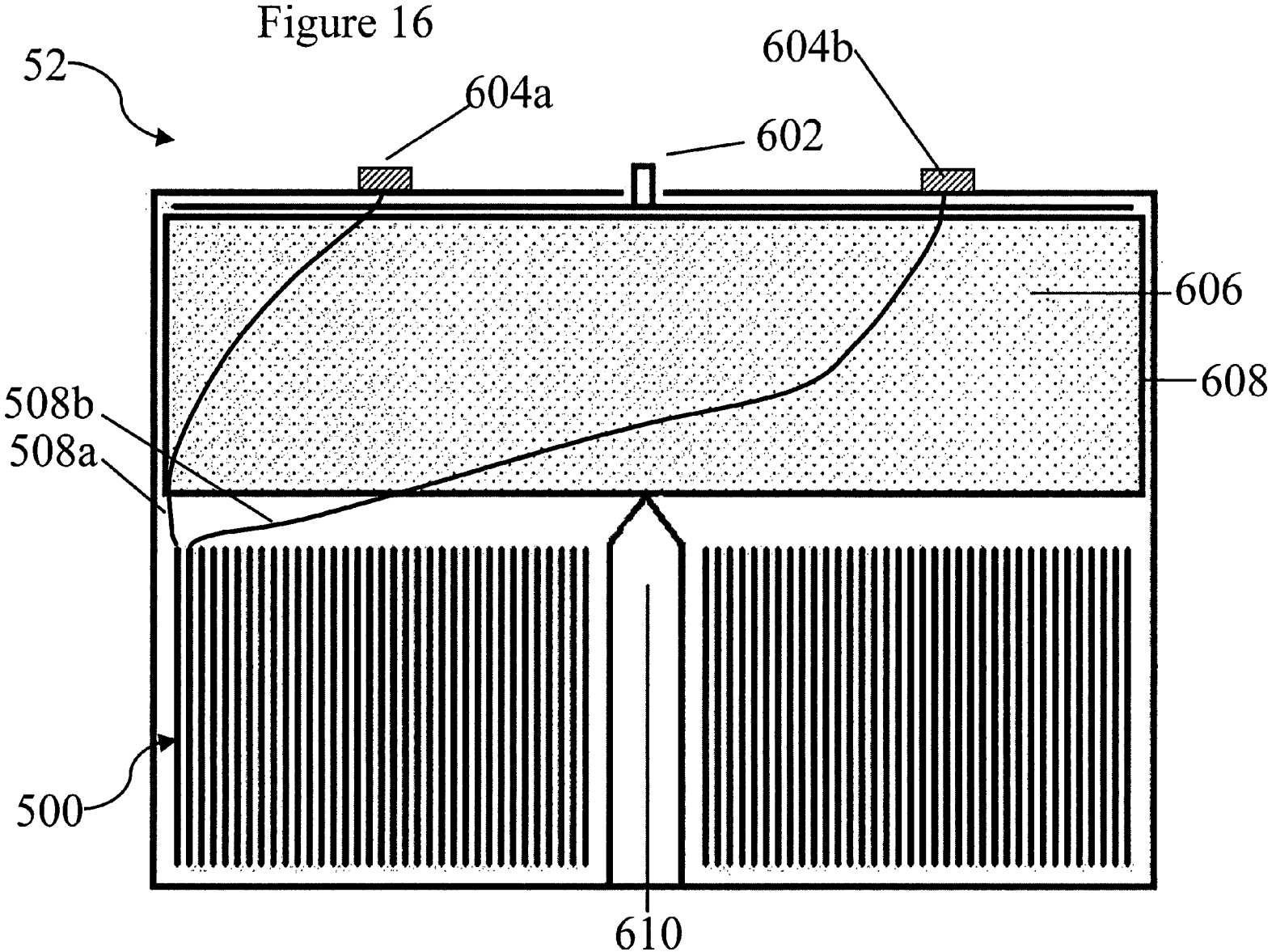
FIG. 16 is a depiction of a miniature thin film battery according to the present invention.

Galvanic cell 500 is activated when separating substrate 506 absorbs electrolyte fluid 606. Initially electrolyte fluid 606 is inside an ampoule 608. At the time of use, ampoule 608 is destroyed by a miniature cutter bur 610, as shown in FIG. 16. Particularly in embodiment 100 of a stun projectile (see FIGS. 6 and 7), ampoule 608 is broken after impact with a target 40 (not shown) when mobile subassembly 104 rams into activator button 602. Momentum from mobile subassembly 104 is thus transferred to ampoule 608 pushing ampoule 608 into cutter bur 610, rupturing ampoule 608 and releasing electrolyte fluid 606. Electrolyte fluid 606 then comes in contact with and is absorbed by separator substrate 506. Thereafter ion transport via electrolyte fluid 606 between cathode 502 and anode 504 completes (and activates) galvanic cell 500 and consequently battery 52.

It will be understood to one skilled in the art of galvanic cells, that because galvanic cell 500 and battery 52 are not activated when the cell is assembled (in the factory before the time of use), galvanic cell 500 and battery 52 are stored in an inactive state. Therefore, galvanic cell 500 and battery 52 preserve charge during storage better than and have a longer shelf life than conventional batteries.

For Example one embodiment of a thin film technology galvanic cell for use in a stun projectile is made as follows:

TABLE 2

| Electrode ribbons | | | | |
|---|---|---|---|---|
| | Thickness | Length | Width | Material |
| Separating substrate | 50 μm | 1400 mm | 3.0 mm | Paper |
| Cathode | 15 μm | 1400 mm | 2.5 mm | $PbO_2$ |
| Anode | 15 μm | 1400 mm | 2.5 mm | Pb |

The ribbons roll up in the form of cylinder having a height 6 mm and diameter 12 mm. The battery is activated by 3 $cm^3$ of electrolyte fluid consisting of 50% $H_2SO_4$+50% $H_2O$. The cell produces 5A of current with an electrical potential of 2V (thus producing 10 Watts of power) for 2 min.

The short-term performance advantage of the thin film battery is obvious in comparison to standard miniature batteries (for example, the standard hearing aid batteries having a similar volume and weight to the above embodiment of a thin film battery) produce a maximum current of 1.5 A at 1.5 V.

It will be clear to one skilled in the art of galvanic cells that the materials and measurements of a thin film technology battery can be modified according to the desired output and physical characteristics of the battery. Such modifications are within the spirit of the current patent. Exemplary parameters for a battery of output potential 0.5-3 V and output current 1-10 A are: separator substrate thickness of 10-50 ?m, electrode layers thickness from 1-50 ?m and electrolyte volume 1-6 $cm^3$.

The advantages of thin film technology chemical battery 52 compared to conventional batteries are the following:

Large electrode surfaces produce large current for comparative small dimensions of the source.

One-time use and short working time (of about 2-10 min) allows decreasing electrolyte and electrode volume, and consequently the dimensions and weight of new chemical source.

Electrodes and membranes are distributed in such a manner that the acceleration of bullet during shutting and interaction with the human body (the target) will cause fast activation of the chemical source by the electrolyte liquids. Thus, the chemical source remains inactivated and preserves charge during storage and flight.

It will be appreciated that the above descriptions are intended only to serve as examples, and that many other embodiments are possible within the spirit and the scope of the present invention.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A wireless projectile for stunning a target comprising:

a) an impact reduction subsystem to decrease injury to the target caused by an impact of the wireless projectile upon the target, said impact reduction subsystem includes a mobile subassembly movable in relation to a projectile body upon impact, said mobile subassembly is mounted on an energy absorbing track such that said mobile subassembly is decelerated by an energy absorbing connection between said mobile subassembly and said energy absorbing track;

b) an attachment mechanism configured to grasp the target, c) an energy delivery subsystem for supplying an electrical energy to the target thereby stunning the target;

wherein said attachment mechanism as further configured to engage said energy delivery subsystem to the target.

2. The wireless projectile of claim 1, further comprising:

d) an integral ring having a groove, said integral ring for sealing between the wireless projectile and a cartridge while firing of the wireless projectile from a conventional firearm.

3. The wireless projectile of claim 1, wherein the wireless projectile is configured to be launched by a conventional firearm.

4. The wireless projectile of claim 1, wherein said attachment mechanism is triggered on proximity to the target.

5. The wireless projectile of claim 1, wherein said attachment mechanism is triggered upon said impact of the wireless projectile upon the target.

6. The wireless projectile of claim 1, wherein said energy delivery subsystem is activated upon said impact of the wireless projectile upon the target.

7. The wireless projectile of claim 1, wherein said energy delivery subsystem includes a battery and said battery is activated upon said impact of the wireless projectile upon the target.

8. The wireless projectile of claim 1, wherein said impact reduction subsystem includes a deformable pad on an impact zone of the wireless projectile.

9. The wireless projectile of claim 1, where said energy delivery subsystem includes a thin film technology galvanic cell.

10. The wireless projectile of claim 1, wherein said energy delivery subsystem includes a thin film technology transformer.

11. The wireless projectile of claim 1, wherein said impact reduction subsystem includes a mobile subassembly, said mobile subassembly being mobile in relation to an impact zone of the wireless projectile.

12. The wireless projectile of claim 11, wherein said mobile subassembly includes at least one component selected from the group consisting of said energy delivery subsystem, said attachment mechanism, an arm, a battery, a transformer, and a capacitor.

13. The wireless projectile of claim 11, wherein a motion of said mobile subassembly relative to said impact zone activates a component of the wireless projectile.

14. The wireless projectile of claim 11, wherein said mobile subassembly includes at least one energy absorbing connection.

15. The wireless projectile of claim 14, wherein said energy absorbing connection includes at least one component selected from the group consisting of a friction connector, a spring, a hydraulic shock absorber, a serrated track and a flexible latch.

16. The wireless projectile of claim 1, wherein said attachment mechanism includes a barbed hook.

17. The wireless projectile of claim 1, wherein said attachment mechanism includes:

(i) a first hook, and (ii) a second hook;

wherein said first hook engages the target at a first angle and said second hook engages the target at an opposing angle.

18. The wireless projectile of claim 1, wherein said attachment mechanism includes an arm.

19. The wireless projectile of claim 18, wherein said arm springs out from a side of the wireless projectile.

20. The wireless projectile of claim 18, further including a mobile subassembly said mobile subassembly being mobile in relation to an impact zone of the wireless projectile, wherein motion of said mobile subassembly relative to said impact zone serves to embed said arm into the target.

21. The wireless projectile of claim 1, wherein said attachment mechanism is configured to distance a first electrode from a second electrode upon said impact of the wireless projectile upon the target and prior to said first electrode engaging the target.

22. A method of stunning a target with a non-lethal projectile comprising:

a) deploying a first electrode upon impact of the non-lethal projectile upon the target said non-lethal projectile including an impact reduction subsystem to decrease injury to the target caused by an impact of the wireless projectile upon the target, said impact reduction subsystem includes a mobile subassembly movable in relation to a projectile body upon impact, said mobile subassembly is mounted on an energy absorbing track such that said mobile subassembly is decelerated by an energy absorbing connection between said mobile subassembly and said energy absorbing track;

b) engaging the target with said first electrode subsequent to said deploying, c) grasping the target between said first electrode and said second electrode during said engaging, and d) passing an electric current through the target between said first electrode and a second electrode subsequent to said engaging, and wherein said deploying distances said first electrode from said second electrode.

23. The method of claim 22, wherein in said step of passing an electrical current through the target, said current passes from said first electrode to a second electrode at a range of at least 10 cm from said first electrode.

24. The method of claim 22, wherein said step of deploying includes extension of an arm away from a body of the non-lethal projectile.

25. The method of claim 22, wherein said step of deploying includes rotation around a hinge.

26. The method of claim 22, wherein said step of deploying is in an arc shaped path.

27. The method of claim 22, wherein said engaging includes attaching said first electrode to the target.

28. A projectile for stunning a target comprising:

a) a first electrode, b) a second electrode configured to deploy away from said first electrode upon an impact of the projectile upon the target, and to engage the target subsequent to said deploying, and wherein when said second electrode is engaged to the target an electric current between said first electrode and said second electrode stuns the target, and wherein said first and second electrodes are configured to grasp the target from opposite directions when engaged to the target and the projectile includes an impact reduction subsystem to decrease injury to the target caused by an impact of the wireless projectile upon the target, said impact reduction subsystem includes a mobile subassembly movable in relation to a projectile body upon impact, said mobile subassembly is mounted on an energy absorbing track such that said mobile subassembly is decelerated by an energy absorbing connection between said mobile subassembly and said energy absorbing track.

29. The projectile of claim 28, wherein said second electrode is configured to extend out from a body of the projectile during said deploying.

30. The projectile of claim 28, wherein said first electrode includes a barbed hook.

31. The projectile of claim 28, wherein said first electrode is located on a body of the projectile.

32. The projectile of claim 28, wherein said first electrode is also configured to deploy upon impact of the projectile on the target.

33. The projectile of claim 28 further comprising:

c) an integral ring having a groove configured to expand and facilitate sealing between the projectile and a cartridge while firing of the projectile from a conventional firearm.

* * * * *